US011801676B2

(12) United States Patent
Mizukami et al.

(10) Patent No.: US 11,801,676 B2
(45) Date of Patent: Oct. 31, 2023

(54) LIQUID DISCHARGE HEAD, LIQUID DISCHARGE DEVICE, LIQUID DISCHARGE APPARATUS

(71) Applicant: Ricoh Company, Ltd., Tokyo (JP)

(72) Inventors: Satoshi Mizukami, Kanagawa (JP); Masahiro Hayashi, Kanagawa (JP); Toshiaki Masuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/938,678

(22) Filed: Jul. 24, 2020

(65) Prior Publication Data

US 2021/0039393 A1 Feb. 11, 2021

(30) Foreign Application Priority Data

Jul. 26, 2019 (JP) ..... 2019-137753

(51) Int. Cl.
*B41J 2/14* (2006.01)

(52) U.S. Cl.
CPC .. *B41J 2/14233* (2013.01); *B41J 2002/14258* (2013.01)

(58) Field of Classification Search
None
See application file for complete search history.

(56) References Cited

U.S. PATENT DOCUMENTS 6,333,066 B1 * 12/2001 Kim ..... C23C 16/0272 204/192.18
9,186,894 B2 11/2015 Mizukami et al.
9,385,298 B2 7/2016 Mizukami et al.
9,595,660 B2 3/2017 Akiyama et al.
9,597,872 B2 3/2017 Mizukami
9,627,606 B2 4/2017 Mizukami
9,889,654 B2 2/2018 Mizukami et al.
9,902,151 B2 2/2018 Mizukami
9,950,524 B2 4/2018 Shinkai et al.
9,956,774 B2 5/2018 Mizukami
9,969,161 B2 5/2018 Shinkai et al.
9,987,843 B2 6/2018 Mizukami
10,103,315 B2 10/2018 Mizukami
10,112,391 B2 10/2018 Mizukami
10,160,208 B2 12/2018 Mizukami
10,239,312 B2 3/2019 Mizukami
10,556,431 B2 2/2020 Mizukami et al.
10,596,581 B2 3/2020 Mizukami
2015/0270472 A1 * 9/2015 Nagahata ..... B41J 2/1628 310/365
2016/0001556 A1 * 1/2016 Masuda ..... B41J 2/1631 310/365

(Continued)

FOREIGN PATENT DOCUMENTS

JP 2016-032007 3/2016

*Primary Examiner* — Erica S Lin
(74) *Attorney, Agent, or Firm* — XSENSUS LLP

(57) ABSTRACT

A piezoelectric element includes an upper electrode, a lower electrode, and a piezoelectric body disposed between the upper electrode and the lower electrode. The piezoelectic body contains lead zirconate titanate. The piezoelectric element also includes a seed layer containing lead disposed between the lower electrode and the piezoelectric body. The seed layer has an amorphous structure at least over an entire surface layer portion on the piezoelectric body side.

18 Claims, 12 Drawing Sheets

(56) References Cited

U.S. PATENT DOCUMENTS

| | | | | |
|---|---|---|---|---|
| 2016/0023466 | A1* | 1/2016 | Chen | B41J 2/164<br>29/890.1 |
| 2019/0044055 | A1 | 2/2019 | Kondo et al. | |
| 2019/0176469 | A1 | 6/2019 | Kuroda et al. | |
| 2020/0039227 | A1 | 2/2020 | Mizukami et al. | |

* cited by examiner

LIQUID DISCHARGE HEAD, LIQUID DISCHARGE DEVICE, LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-137753, filed on Jul. 26, 2019 in the Japan Patent Office, the entire disclosure of which is hereby incorporated by reference herein.

BACKGROUND

Technical Field

The present disclosure relates to a piezoelectric element, a liquid discharge head, a liquid discharge device, a liquid discharge apparatus, and a method for manufacturing piezoelectric element.

Related Art

It is known that a piezoelectric element, including a piezoelectric body (hereinafter, referred to as PZT), contains lead zirconate titanate (Pb(ZrTi)O3) between a lower electrode and an upper electrode.

SUMMARY

The present disclosure describes a piezoelectric element, a liquid discharge head, a liquid discharge device, a liquid discharge apparatus, and methods for manufacturing the same, which overcome the problems in the conventional art.

In an exemplary aspect, a piezoelectric element includes an upper electrode, a lower electrode, a piezoelectric body containing lead zirconate titanate disposed between the lower electrode and the upper electrode, and a seed layer containing lead disposed between the lower electrode and the piezoelectric body. The seed layer has an amorphous structure at least over an entire surface layer portion on the piezoelectric body side.

In an exemplary aspect, the seed layer is lead titanate.

In an exemplary aspect, a composition ratio of Pb/Ti of lead titanate is between 0.7 and 1.5.

In an exemplary aspect, a thickness of the seed layer is between 3 nm and 15 nm.

In an exemplary aspect, the seed layer is lead zirconate titanate.

In an exemplary aspect, the composition ratio of Ti/(Zr+Ti) of the lead zirconate titanate is 0.3 or more.

In an exemplary aspect, the lower electrode is composed of a platinum layer and an adhesion layer containing titanium oxide.

In an exemplary aspect, a composition ratio Ti/(Zr+Ti) of lead zirconate titanate forming the piezoelectric body is between 0.4 and 0.55.

In an exemplary aspect, the piezoelectric body has an orientation degree of (100) orientation of 99% or more measured by θ-2θ by an X-ray diffraction method.

In an exemplary aspect, a liquid discharge head includes a piezoelectric element having an upper electrode, a lower electrode, a piezoelectric body containing lead zirconate titanate disposed between the lower electrode and the upper electrode, and a seed layer containing lead disposed between the lower electrode and the piezoelectric body. The seed layer has an amorphous structure at least over an entire surface layer portion on the piezoelectric body side.

In an exemplary aspect, a liquid discharge device includes a liquid discharge head having a piezoelectric element including an upper electrode, a lower electrode, a piezoelectric body containing lead zirconate titanate disposed between the lower electrode and the upper electrode, and a seed layer containing lead disposed between the lower electrode and the piezoelectric body. The seed layer has an amorphous structure at least over an entire surface layer portion on the piezoelectric body side.

In an exemplary aspect, the liquid discharge device also includes at least one of a head tank to store liquid to be supplied to the liquid discharge head, a carriage to mount the liquid discharge head, a supply device to supply the liquid to the liquid discharge head, a maintenance device to maintain the liquid discharge head, and a drive device to move the carriage in a main scanning direction, together with the liquid discharge head to form a single unit.

In an exemplary aspect, a liquid discharge apparatus includes a piezoelectric element having an upper electrode, a lower electrode, a piezoelectric body containing lead zirconate titanate disposed between the lower electrode and the upper electrode, and a seed layer containing lead disposed between the lower electrode and the piezoelectric body. The seed layer has an amorphous structure at least over an entire surface layer portion on the piezoelectric body side.

In an exemplary aspect, a method of forming a piezoelectric element includes providing an upper electrode and a lower electrode, providing a piezoelectric body containing lead zirconate titanate between the lower electrode and the upper electrode, and forming a seed layer containing lead, which has an amorphous structure over at least the entire surface layer portion on the piezoelectric body side, on the lower electrode directly or through another layer. The crystal of lead zirconate titanate is grown on the seed layer to form the piezoelectric body.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
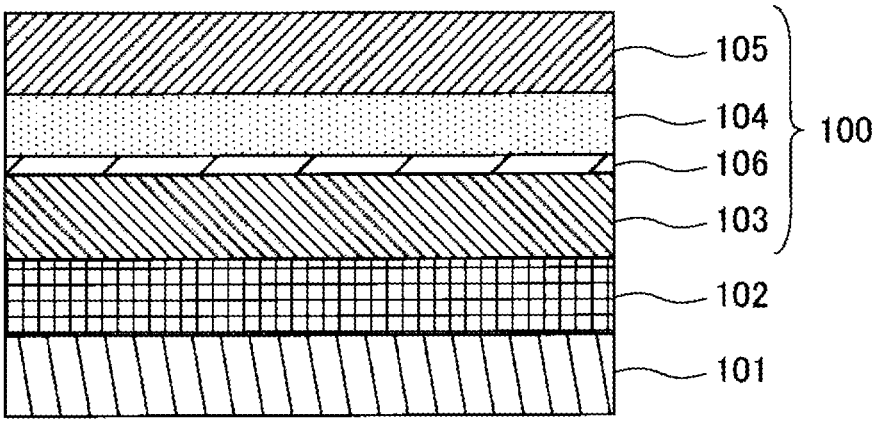
FIG. 1 is an explanatory diagram illustrating an example of a layer configuration of the piezoelectric element 100 according to exemplary aspects of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing the exemplary embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the exemplary embodiments are described with technical limitations with reference to the attached drawings, such description is not intended to limit the scope of the disclosure, and all the components or elements described in the embodiments of this disclosure are not necessarily indispensable. As used herein, the singular forms "a", "an", and "the" are intended to include the plural forms as well, unless the context clearly indicates otherwise.

Hereinafter, a liquid discharge head, a liquid discharge device, a liquid discharge apparatus, and a method for manufacturing a liquid discharge head according to the present disclosure is described with reference to the drawings. Note that the present disclosure is not limited to the following exemplary embodiments and other embodiments may be possible without departing from the scope of the present disclosure Additionally, the following embodiments may be modified by, e.g., addition, modification, or omission without departing from the scope of the disclosure as would be recognized by one skilled in the art. Any aspects having advantages as described for the following exemplary embodiments according to the present disclosure are included within the scope of the present disclosure.

A liquid discharge head according to the present disclosure includes a channel forming member to form a channel of liquid. The channel forming member is made of Si, and a natural oxide film having a film thickness of 2 nm or more is formed on an outermost surface of the channel forming member. A surface treatment film is formed on and in contact with the natural oxide film.

FIG. 1 is an explanatory diagram illustrating an example of a layer configuration of the piezoelectric element 100 according to exemplary aspects of the present disclosure.

FIG. 1 shows a layer configuration of the piezoelectric element 100 in the present embodiment. The piezoelectric element 100 according to the present exemplary embodiment includes, a lower electrode layer 103, a piezoelectric film 104, an upper electrode layer 105, a seed layer 106 interposed between the lower electrode layer 103 and the piezoelectric film 104.

The liquid discharge head includes a substrate 101, a diaphragm 102, and the piezoelectric element 100. A specific configuration of the liquid discharge head will be described later.

The lower electrode layer 103 includes a metal material, and is formed using platinum (Pt) having high heat resistance and low reactivity. The piezoelectric film 104 includes PZT (lead zirconate titanate: Pb(ZrTi) O3). In this embodiment, a seed layer 106 that includes PT (lead titanate: PbTiO3) is formed on the lower electrode layer 103 in order to control the crystalline orientation of PZT. The piezoelectric film 104 is formed on the seed layer 106.

The piezoelectric element of the present embodiment is obtained by forming a piezoelectric film 104 that includes (100)-oriented PZT having good piezoelectric properties on a lower electrode layer 103 that includes (111)-oriented PT.

Figure 2:
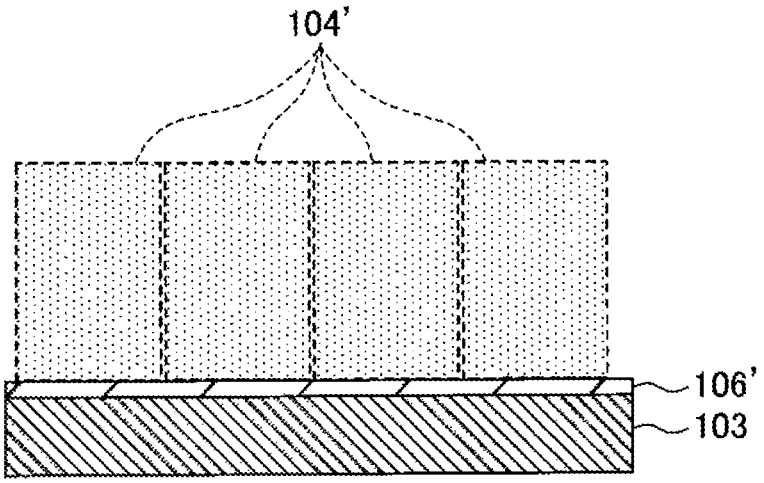
FIG. 2 illustrates comparative example 1 in which a piezoelectric film is formed on a seed layer formed on the lower electrode layer according to exemplary aspects of the present disclosure.

FIG. 2 illustrates comparative example 1 in which a piezoelectric film 104' is formed on a seed layer 106' that is formed on the lower electrode layer 103. The seed layer 106' includes a PT layer in which the entire layer, including the surface layer, is crystallized. Since the seed layer 106' is affected by the crystal characteristics of the lower electrode layer 103 that is made of (111) Pt, the seed layer 106' tends to have a crystal structure of (111) orientation.

As a result, the PZT piezoelectric film 104' formed (crystal-grown) on the seed layer 106' also tends to have a (111)-oriented crystal structure. Therefore, it is difficult to obtain a desired piezoelectric film 104 that includes PZT having enough (100) orientation and excellent piezoelectric characteristics.

Figure 3:
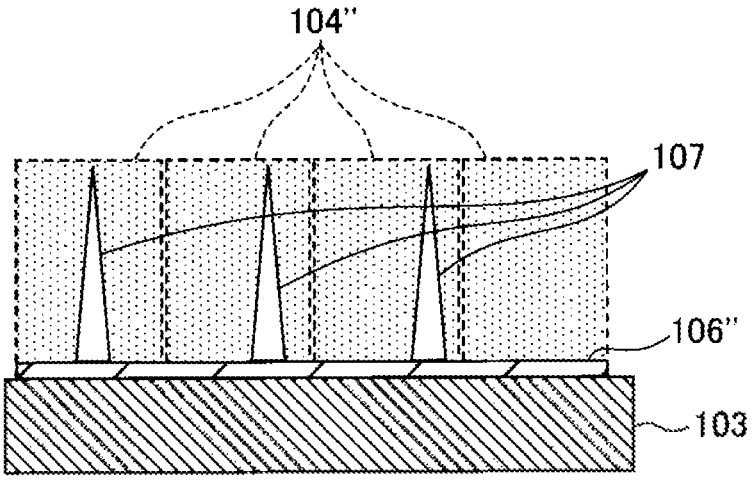
FIG. 3 illustrates comparative example 2 in which a piezoelectric film is formed on a seed layer having an amorphous region and a crystallized region according to exemplary aspects of the present disclosure.

FIG. 3 shows comparative example 2 in which a piezoelectric film 104" is formed on a seed layer 106" having an amorphous region and a crystallized region. The seed layer 106" is composed of a PT layer in which a crystallized region and an amorphous region are mixed. In this case, the amorphous region in the seed layer 106" prevents transmission of crystal characteristics from the lower electrode layer 103 that includes (111)-oriented Pt to the piezoelectric film 104". Then, by nucleation on the seed layer 106" (the trigger for the (100) orientation), the piezoelectric film 104" has a (100) oriented crystal structure.

However, a crystallized region exists in the seed layer 106" of comparative example 2. Therefore, the crystallized region is likely to have a crystal structure of (111) orientation, affected by crystal characteristics from the lower electrode layer 103 made of (111) PT. As a result, the PZT piezoelectric film 104" formed (crystal-grown) on the seed layer 106" also tends to have a (111)-oriented crystal structure.

Therefore, in comparative example 2, although a piezoelectric film 104" having a (100) orientation crystal structure can be formed, a (111) orientation crystal structure exists in a part thereof. That is, the piezoelectric film 104 is not sufficiently oriented to the (100) orientation. As a material of the diaphragm 20, a material produced by subjecting silicon (Si), $SiO_2$, silicon nitride ($Si_3N_4$), or the like to a chemical vapor deposition (CVD) method can be used.

Figure 4:
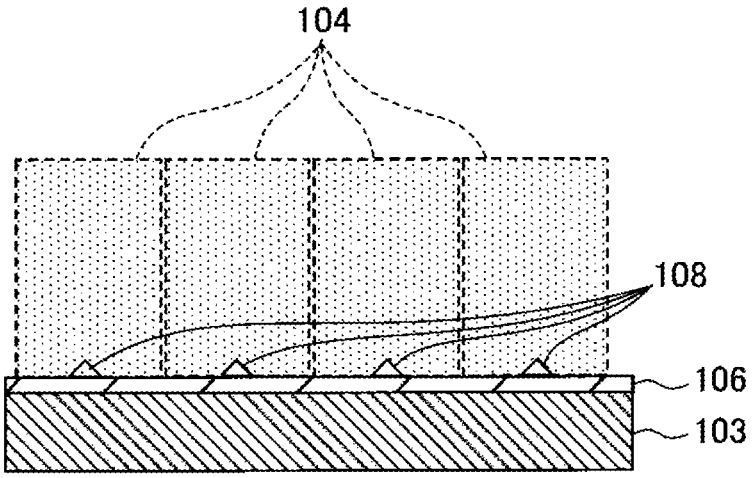
FIG. 4 illustrates an embodiment in which the piezoelectric film is formed on the seed layer in which the entire region is an amorphous region according to exemplary aspects of the present disclosure.

FIG. 4 illustrates an embodiment in which the piezoelectric film 104 is formed on the seed layer 106 in which the entire region is an amorphous region.

As shown in FIG. 4, the piezoelectric film 104 is formed by forming (crystal growing) PZT having a (100) orientation based on the nucleation 108 from the seed layer 106 made of PT. At this time, it is important that the seed layer 106 has an amorphous structure over the entire surface layer portion on the piezoelectric film 104. When the seed layer 106 includes a region other than the region where the piezoelectric film 104 is formed, the amorphous structure extends over the entire surface layer in the region where the piezoelectric film 104 is formed. That is, at least the entire surface layer portion of the seed layer 106 on the piezoelectric film 104 side has an amorphous structure. Thus, transmission of crystal information (crystal influence) from the (111)-oriented lower electrode layer 103 to the piezoelectric film 104 can be prevented over the entire region.

Further, on the seed layer 106, the piezoelectric film 104 having a crystal structure in which the entire region is (100)-oriented can be obtained.

Here, whether or not the seed layer 106 has an amorphous structure can be confirmed by observing a crystal lattice image of the seed layer 106 using a transmission electron microscope (TEM). When a crystal lattice image cannot be confirmed over at least the entire surface layer portion of the seed layer 106 on the piezoelectric film 104 side, it can be determined that the entire region of at least the surface layer portion of the seed layer 106 on the piezoelectric film 104 side has an amorphous structure.

Figure 5:
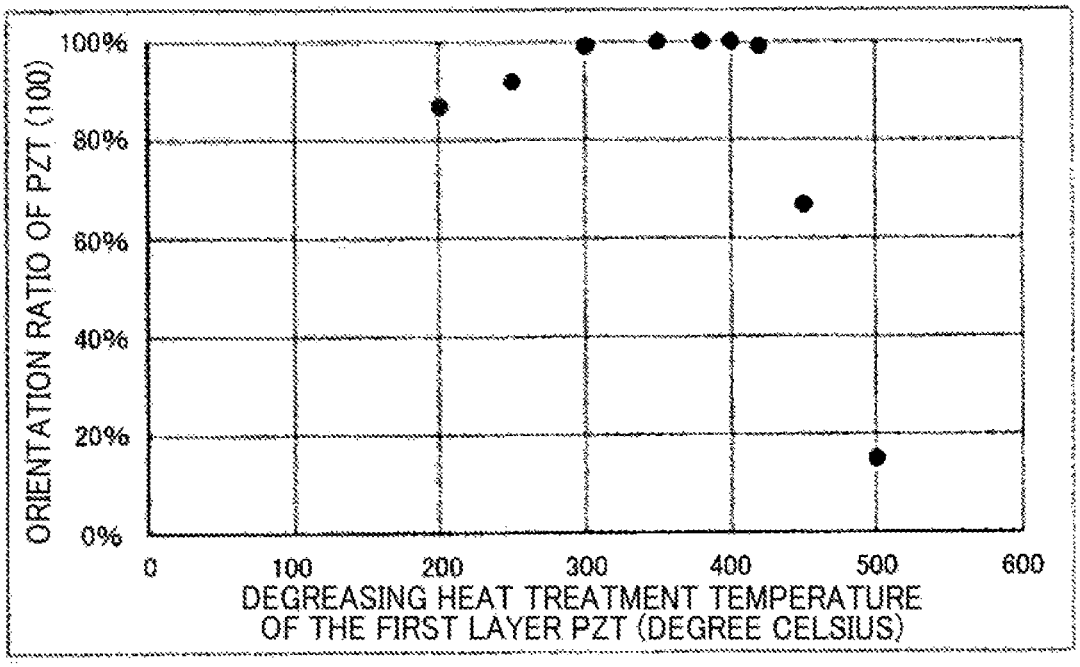
FIG. 5 is a graph of a relationship between the degreasing temperature of the first layer of PZT and the degree of (100) orientation (orientation ratio) of PZT according to exemplary aspects of the present disclosure.

FIG. 5 is a graph illustrating a relationship between the degreasing temperature of the first layer of PZT and the degree of (100) orientation (orientation ratio) of PZT. In the temperature range where the degreasing temperature of the first layer of PZT is lower than 300° C., it can be seen that the (100) orientation ratio of PZT is slightly lower. Further, it can be seen that in a temperature range higher than 420 [° C.], the (100) orientation ratio of PZT is significantly reduced.

Next, the cross-sectional state of the seed layer 106 made of PT was confirmed. In a temperature range of less than 300° C., PZT and the seed layer 106 were mixed, and a clear seed layer 106 could not be confirmed. In the temperature range of 450° C. or higher, the seed layer 106 can be confirmed, but the seed layer 106 was crystallized. On the other hand, in a temperature range of 300° C. or more and 420° C. or less where PZT shows a favorable (100) orientation ratio, the seed layer 106 was present as an amorphous film.

That is, in the case where the degreasing temperature of the first layer of PZT is in a temperature range of 300° C. or more and 420° C. or less, at least the entire surface layer of the seed layer 106 on the piezoelectric film 104 side has an amorphous structure. This phenomenon can be confirmed by observing a crystal lattice image near the seed layer 106 using a transmission electron microscope (TEM) and analyzing the crystal state of the seed layer 106 by TEM-EDS.

Next, another configuration of the piezoelectric element 100 of the present embodiment will be further described. In this configuration, the lower electrode layer 103 and the upper electrode layer 105 need to have sufficient electric resistance.

In order for the piezoelectric element 100 to exhibit a good function as an actuator for displacing the diaphragm layer 102, the decrease in displacement when the actuator is continuously driven is required to be small.

To better form the lower electrode layer 103 and the upper electrode layer 105 to satisfy these requirements, the lower electrode layer 103 and the upper electrode layer 105 may have a multilayer structure.

Figure 6:
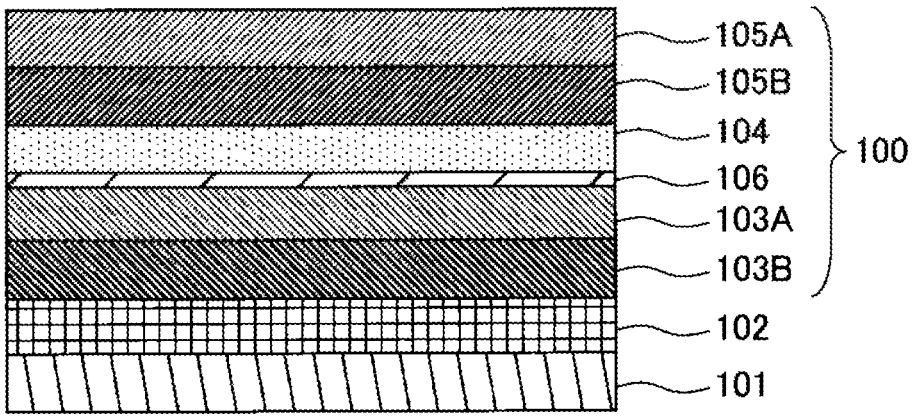
FIG. 6 illustrates another configuration example in which each of the lower electrode layer and the upper electrode layer has the multilayer structure according to exemplary aspects of the present disclosure.

FIG. 6 illustrates another configuration example in which each of the lower electrode layer 103 and the upper electrode layer 105 has the multilayer structure. The piezoelectric element 100 includes a first lower electrode layer 103A and a first upper electrode layer 105A, and a second lower electrode layer 103B and a second upper electrode layer 105B. The first lower electrode layer 103A and the first upper electrode layer 105A are made of a metal layer capable of sufficiently obtaining electrical resistance. The second lower electrode layer 103B and the second upper electrode layer 105B are made of a conductive oxide electrode layer for suppressing a decrease in displacement or the like when continuously driven.

In the exemplary embodiment, the pressure chamber substrate 101 is formed of a monocrystalline silicon substrate having a thickness of 100 to 600 μm. As plane orientations of the above-described monocrystalline silicon substrate, three types (100), (110), and (111) are known. Generally, (100) and (111) planes are widely used. In the exemplary embodiment, a monocrystalline silicon substrate having (100) plane orientation is mainly employed.

Figure 7:
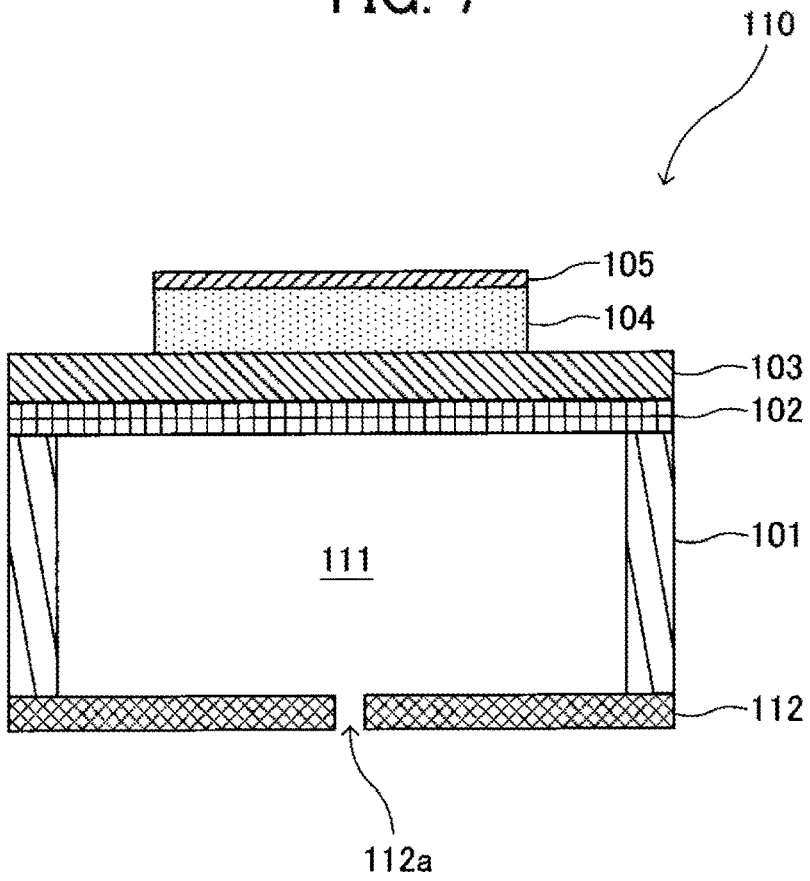
FIG. 7 illustrates a main part of a liquid ejection head as a piezoelectric device using a piezoelectric element according to exemplary aspects of the present disclosure.

FIG. 7 illustrates a main part of a liquid ejection head 110 as a piezoelectric device using the piezoelectric element 100 of the exemplary embodiment. The liquid discharge head 110 has a pressure chamber 111 on the back surface (the surface opposite to the piezoelectric element 100) of the substrate 101 on which the piezoelectric element 100 is formed. The nozzle plate 112 on which the nozzles 112*a* are formed is also joined. The liquid discharge head 110 applies pressure to the liquid filled in the pressure chamber 111 by driving the piezoelectric element 100 to displace the diaphragm 102, and discharges the liquid from the nozzle 112*a*.

In fabricating the pressure liquid chamber 111, a monocrystalline silicon substrate is processed by etching. In such a case, anisotropic etching is typically used as a method of etching. The anisotropic etching uses the property that an etching speed is different for each plane orientation of a crystal structure. For example, for the anisotropic etching in which the substrate is immersed in an alkaline solution, such as potassium hydroxide (KOH), the etching speed of (111) plane is approximately 1/400 of the etching speed of (100) plane.

Therefore, a structure having an inclination of about 54° can be formed in (100) plane orientation. On the other hand, a deep groove can be formed in (110) plane orientation. Therefore, an arrangement density can be increased while rigidity is further maintained. In the present embodiment, a monocrystalline silicon substrate having (110) plane orientation can be also used. In such a case, the monocrystalline silicon substrate having (110) plane orientation is used by paying attention to a fact that silicon dioxide ($SiO_2$) as a mask material may be also etched.

The diaphragm 102 is deformed and displaced by receiving a force generated by the piezoelectric film 104, and discharges a discharge liquid in the pressure liquid chamber 111. Therefore, a component having predetermined strength is preferably used as the diaphragm 102.

As a material of the diaphragm 102, a material produced by subjecting silicon (Si), $SiO_2$, silicon nitride ($Si_3N_4$), or the like to a chemical vapor deposition (CVD) method can be used. A material having a linear expansion coefficient close to that of each of the lower electrode 103 and the piezoelectric film 104 is preferably selected. As a material of the piezoelectric film 104, lead zirconate titanate (PZT) is generally used. From the above, a material having a linear expansion coefficient of $5\times10^{-6}$ to $10\times10^{-6}$ close to a linear expansion coefficient $8\times10^{-6}$ (l/K) is preferable. Furthermore, a material having a linear expansion coefficient of $7\times10^{-6}$ to $9\times10^{-6}$ is more preferable.

Examples of the materials of the diaphragm 102 include aluminum oxide, zirconium oxide, iridium oxide, ruthenium oxide, tantalum oxide, hafnium oxide, osmium oxide, rhenium oxide, rhodium oxide, palladium oxide, and compounds of the foregoing materials. Using such materials, the diaphragm 102 is produced by a spin coater using a sputtering method or a sol-gel method.

The film thickness is preferably in a range of from 0.1 μm to 10 μm, and more preferably in a range of from 0.5 μm to 3 μm. If the film thickness of the diaphragm 102 is less than the range, the pressure liquid chamber 31 may not be easily processed. If the film thickness of the diaphragm 102 is greater than the range, the diaphragm 102 may be less deformed and displaced, thus hampering stable discharge of droplets.

As the metal material of the first lower electrode 103A and the first upper electrode 105A in FIG. 6, platinum (Pt) having high heat resistance and low reactivity is typically used. However, platinum may not have a sufficient barrier property against lead, and platinum group elements, such as iridium and platinum-rhodium, or alloy films of the foregoing materials may be used. When platinum is used, adhesion of platinum with a base (in particular, $SiO_2$) may be poor. Therefore, for example, Ti, $TiO_2$, Ta, $Ta_{205}$, or $Ta_3N_5$ is preferably laminated in advance.

As a method of manufacturing the metal electrode film, vacuum film formation such as a sputtering method or a vacuum vapor deposition method is generally used. The film thickness is preferably in a range of from 0.05 μm to 1 μm, and more preferably in a range of from 0.1 μm to 0.5 μM.

An oxide electrode film formed of SrRuO3 or LaNiO3 as a material may be used for the second lower electrode 103B and the second upper electrode 105B in FIG. 6. A material selected for the second lower electrode 103B influences the determination of a direction having an orientation priority because the material has an influence on orientation control of an electromechanical transducer film (for example, a PZT film) 12 produced on the oxide electrode film.

It is preferable that PZT (100) be preferentially oriented regardless of the material or structure of the lower electrode layer 103 or the second lower electrode layer 103B that affects the orientation of the piezoelectric film 104. Therefore, first, a seed layer having an amorphous structure is formed on the lower electrode layer 103 or the second lower electrode layer 103B over at least the entire surface layer portion. After that, a PZT piezoelectric film 104 is formed. As a material for the seed layer 106, PbTiO3 or PZT is preferable. When the seed layer 106 of PbTiO3 is used, the composition ratio Pb/Ti of Pb and Ti is preferably 0.7 or more and 1.5 or less, more preferably 1.0 or more and 1.2 or less. Outside of this range, the (100) orientation ratio of PZT constituting the piezoelectric film 104 decreases.

When the PZT seed layer 106 is used, its composition ratio Pb/(Ti+Zr) is preferably 0.7 or more and 1.5 or less, and more preferably 1.0 or more and 1.2 or less. Outside of this range, the (100) orientation rate of PZT forming the piezoelectric film 104 decreases.

The composition ratio of Ti/(Zr+Ti) is preferably 0.3 or more, more preferably 0.4 or more. Outside of this range, the (100) orientation rate of PZT forming the piezoelectric film 104 decreases.

The thickness of the seed layer 106 in the present embodiment is preferably 3 nm or more and 15 nm or less, more preferably 6 [nm] or more and 12 nm or less. Outside of this range, the (100) orientation ratio of PZT constituting the piezoelectric film 104 decreases.

In the exemplary embodiment, PZT(100) preferably has a priority orientation. A crystal orientation is represented by p(hkl)=l(hkl)/Σl(hkl) [p(hkl): orientation degree in (hkl) plane direction, l(hkl): peak intensity in any orientation, Σl(hkl): sum of peak intensities. When the sum of peak intensities obtained by θ-2θ measurement in an X-ray diffraction method is assumed to be 1, an orientation degree in (100) orientation calculated on the basis a ratio of a peak intensity in each orientation is preferably 0.99 or more, and more preferably 0.995 or more. When the orientation degree is less than the value, a sufficient piezoelectric strain may not be obtained, and a displacement may not be secured sufficiently.

PZT is mainly used as the material of the piezoelectric film 104. The PZT is a solid solution of lead zirconate ($PbTiO_3$) and titanium acid ($PbTiO_3$) and has a characteristic different according to a ratio of the lead zirconate ($PbTiO_3$) and the titanium acid ($PbTiO_3$). When the ratio of $PbZrO_3$ and $PbTiO_3$ is 53:47, the PZT film has a generally excellent piezoelectric property. The composition is represented by a chemical formula of $Pb(Zr_{0.53}Ti_{0.47})O3$, generally, PZT(53/47).

An example of composite oxide other than the PZT includes barium titanate. In such a case, barium alkoxide and titanium alkoxide compounds are used as a starting material and are dissolved in a common solvent, to prepare a barium titanate precursor solution. If it exceeds this range, excessive Pb tends to cause dielectric breakdown.

Figure 8:
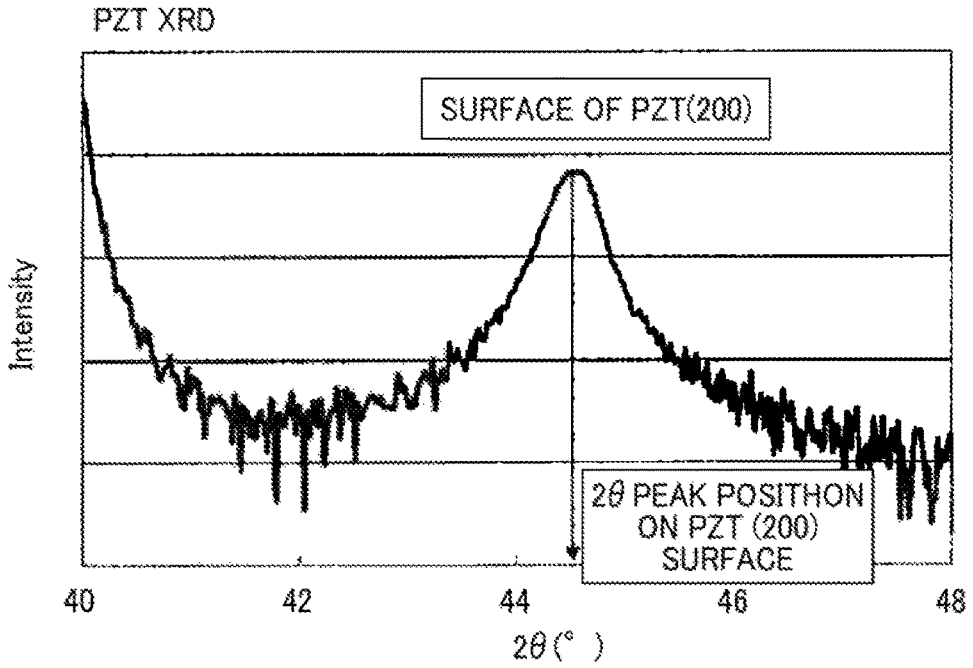
FIG. 8 is a graph of an example of the result of θ-2θ measurement of the PZT by an X-ray diffraction method according to exemplary aspects of the present disclosure.

The composition ratio of Pb/(Zr+Ti) of PZT forming the piezoelectric film 104 is preferably 0.9 or more and 1.3 or less, and more preferably 1.0 or more and 1.2 or less. Below this range, Pb becomes insufficient and it becomes impossible to secure a sufficient amount of displacement. On the other hand, if it exceeds this range, Pb becomes excessive and dielectric breakdown easily occurs. A composition ratio of Pb/(Zr/Ti) is preferably 0.40 or more and 0.55 or less, and more preferably 0.45 or more and 0.53 or less. If it falls below this range, Pb will be insufficient and the displacement will also be insufficient. If it exceeds this range, excessive Pb tends to cause dielectric breakdown (illustrated in FIG. 8). A composition ratio of Zr/Ti is preferably 0.40 or more and 0.55 or less, and more preferably 0.45 or more and 0.53 or less when being represented by Ti/(Zr+Ti).

As a producing method, the composite oxides can be produced by a spin coater using a sputtering method or a sol-gel method. In such a case, because patterning is necessary, a desired pattern is obtained by photolithoetching. When the PZT is manufactured by the sol-gel method, lead acetate, zirconium alkoxide, and titanium alkoxide compounds are used as starting materials and are dissolved in methoxyethanol functioning as a common solvent and a uniform solution is obtained. Thereby, a PZT precursor solution can be produced. Since a metal alkoxide compound is easily hydrolyzed by atmospheric water, a stabilizer, such as acetylacetone, acetic acid, or diethanolamine may be appropriately added to the PZT precursor solution.

The film thickness of the piezoelectric film 104 is preferably in a range of from 0.5 μm to 5 μm, and more preferably in a range of from 1 μm to 2 μm. If the film thickness is less than the range, the pressure liquid chamber 31 may not be easily processed. If the film thickness is greater than the range, the substrate may be less deformed and displaced, thus hampering stable discharge of discharge liquid, or the process time increases because the number of stacked processes increases.

Figure 9A:
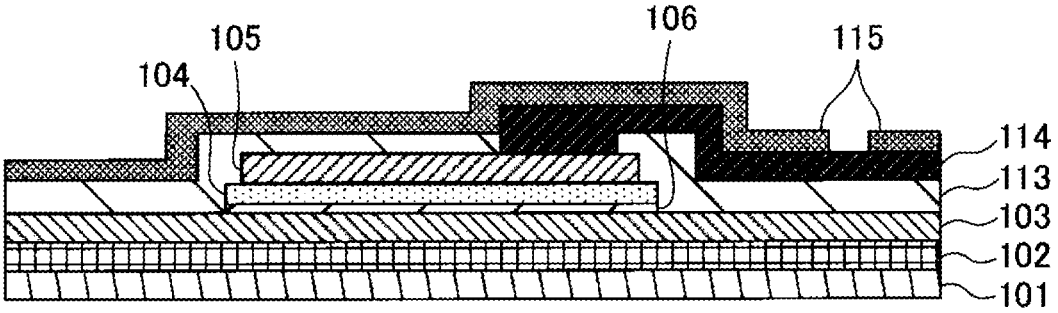
FIG. 9A illustrates an example of the piezoelectric element including the insulating protective films and the lead wirings according to exemplary aspects of the present disclosure.
Figure 9B:
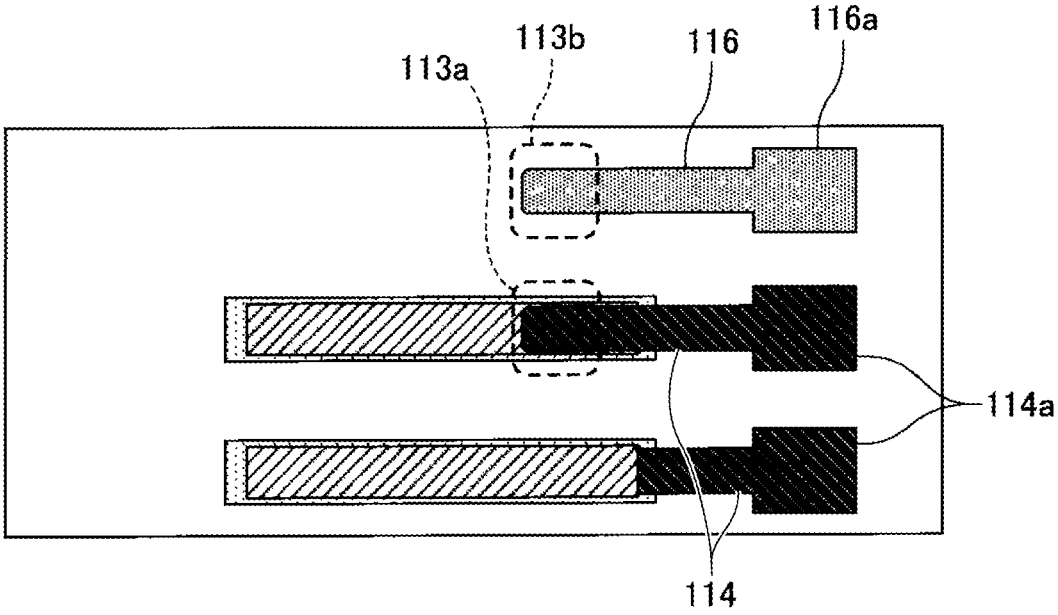
FIG. 9B is another illustration of the example of the piezoelectric element including the insulating protective films and the lead wirings according to exemplary aspects of the present disclosure.

FIGS. 9A and 9B illustrate the piezoelectric element 100 including the insulating protective films 113 and 115 and the lead wirings 114 and 116. The first insulating protective film 113 has a contact hole 113*a*, and the upper electrode layer 105 and the individual lead wiring 114 are electrically connected. The first insulating protection film 113 has a contact hole 113*b*, and the lower electrode layer 103 and the lead wiring 116 are electrically connected.

A second insulating protective film 115 is formed on these lead wires 114 and 116. An opening is provided in a part of the second insulating protective film 115 so that the lead wirings 114 and 116 are exposed. Part of this opening becomes the electrode pads 114*a* and 116*a*.

As the first insulating protective film 113, a dense inorganic material is preferably used. The dense inorganic material is a material that prevents damage to the piezoelectric element 100 due to a film forming/etching process and also prevents permeation of atmospheric moisture. Examples of a preferable method for forming the first insulating protective film 113 include an evaporation method and an ALD method. In particular, the ALD method is preferable because the choice of usable materials is wide.

Examples of preferable material for the first insulating protective film 113 include an oxide film used for ceramic materials, such as $Al_2O_3$, $ZrO_2$, $Y_2O_3$, $Ta_2O_3$, and $TiO_2$. In particular, according to the ALD method, a thin film with quite high film density is produced, thus reducing damage to the piezoelectric film 104 during manufacturing process.

The first insulating protective film 113 include has a thickness that is large enough to obtain a protection performance of the piezoelectric element 100 and is small enough not to hamper the displacement of the diaphragm 102. The film thickness of the first insulating protective film 113 is preferably in the range from 20 nm to 100 nm. When the film thickness is greater than 100 nm, the displacement of the diaphragm layer 102 is reduced, so that the discharge efficiency of the liquid discharge head 110 is reduced. When the film thickness is smaller than 20 nm, the function of the piezoelectric element 100 as a protective layer is insufficient, so that the performance of the piezoelectric element 100 is reduced.

The first insulating protective film 113 may have two layers. In this case, it is preferable to provide an opening near the upper electrode layer 105 so as not to prevent the vibration displacement of the diaphragm layer 102 while increasing the thickness of the second insulating protective film. Any oxide, nitride, carbide or composite compound thereof can be used as the second insulating protective film. It is preferable to use SiO2 commonly used in semiconductor devices.

Examples of a method for forming the first insulating protective film 113 include a CVD method and a sputtering method. In consideration of the step in the pattern portion such as the lead wirings 114 and 116, it is preferable to use a CVD method that can form a film isotropically. That is, the electric field intensity applied to the first insulating protective film 113 has to be set in a range in which first insulating protective film 113 is not dielectrically broken down. Consideration about a surface properties or pin holes of the base of the second layer of first insulating protective film 113, the film thickness is preferably equal to 200 nm or more, and more preferably 500 nm or more.

The material of the wiring 114 and 116 is preferably a metal electrode material composed of any one of an Ag alloy, Cu, Al, Au, Pt, and Ir. As a manufacturing method of the wiring, a sputtering method or a spin coating method is used. Then, a desired pattern is obtained by photolithography, for example. The film thickness is preferably in a range of from 0.1 μm to 20 μm, and more preferably in a range of from 0.2 μm to 10 μm. If the film thickness is smaller than this range, the electric resistance value becomes large, and it becomes impossible to supply a sufficient current to the electrodes, and the ejection becomes unstable. On the other hand, when the film thickness is larger than this range, the process time becomes longer.

Further, it is preferable that the contact resistance in the contact holes 113*a* and 113*b* of 10 μm×10 μm is 10Ω or less for the common lead-out wiring 116 and 1Ω or less for the individual lead-out wiring 114. More preferably, the contact resistance is 5Ω or less for the common lead wiring 116 and 0.5Ω or less for the individual lead wiring 114. If it exceeds this range, a sufficient current cannot be supplied, and a problem occurs during ejection.

The second insulating protective film 115 is a passivation layer having a function as a protective layer for the individual lead-out wiring 114 and the common lead-out wiring 116. As illustrated in FIGS. 9A and 9B, the second insulating protective film 115 covers the individual lead wiring 114 and the common lead wiring 116 except for the individual electrode pad 114*a* and the common electrode pad 116*a*. Therefore, inexpensive Al or an alloy material containing Al as a main component can be used as a material for the lead wirings 114 and 116. As a result, a low-cost and highly reliable liquid ejection head 110 can be obtained.

As the material of the second insulating protective film 115, any inorganic or organic material can be used, and particularly, a material having low moisture permeability is preferably used. Oxides, nitrides, carbides and the like can be used as the inorganic material. As the organic material, polyimide, acrylic resin, urethane resin, or the like can be used. However, in the case of an organic material, it is necessary to increase the film thickness, which is not suitable for patterning the second insulating protective film 115.

Therefore, it is preferable that the material of the second insulating protective film 115 be a thin film and an inorganic material capable of exhibiting a wiring protection function. In particular, when the lead wirings 114 and 116 are made of Al, it is generally preferable to use Si3N4 as the material of the second insulating protective film 115.

The thickness of the second insulating protective film 115 is preferably 200 nm or more, and more preferably 500 nm or more. When the film thickness is small, a sufficient passivation function cannot be exhibited. In this case, the wiring material is disconnected due to corrosion, and the reliability of the liquid ejection head 110 is reduced.

Further, it is preferable that an opening is formed in the second insulating protective film 115 above the piezoelectric element 100 and above the diaphragm layer 102 around the piezoelectric element 100. Thus, the second insulating protective film 115 does not prevent the displacement of the diaphragm layer 102.

Figure 10:
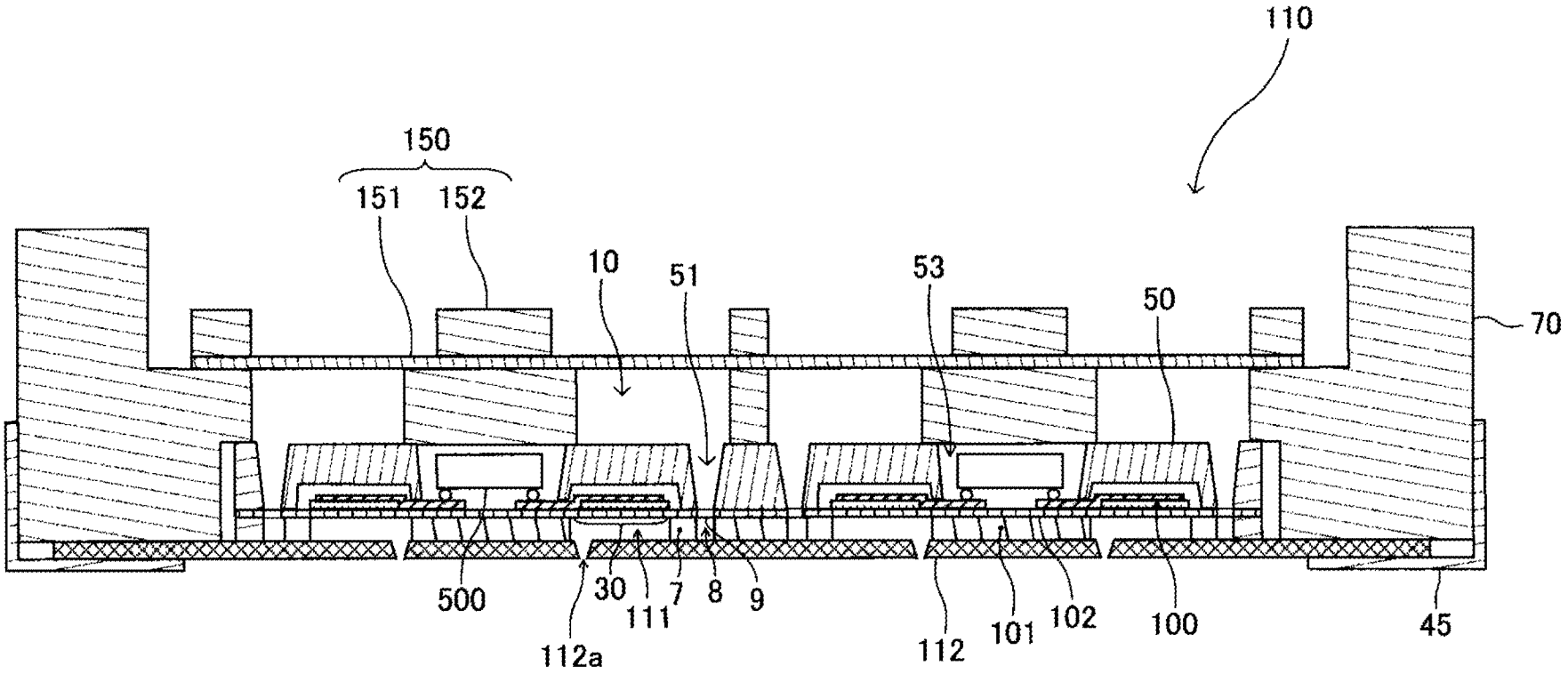
FIG. 10 is a cross-sectional explanatory view along a direction orthogonal to a nozzle array direction of the head according to exemplary aspects of the present disclosure.
Figure 11:
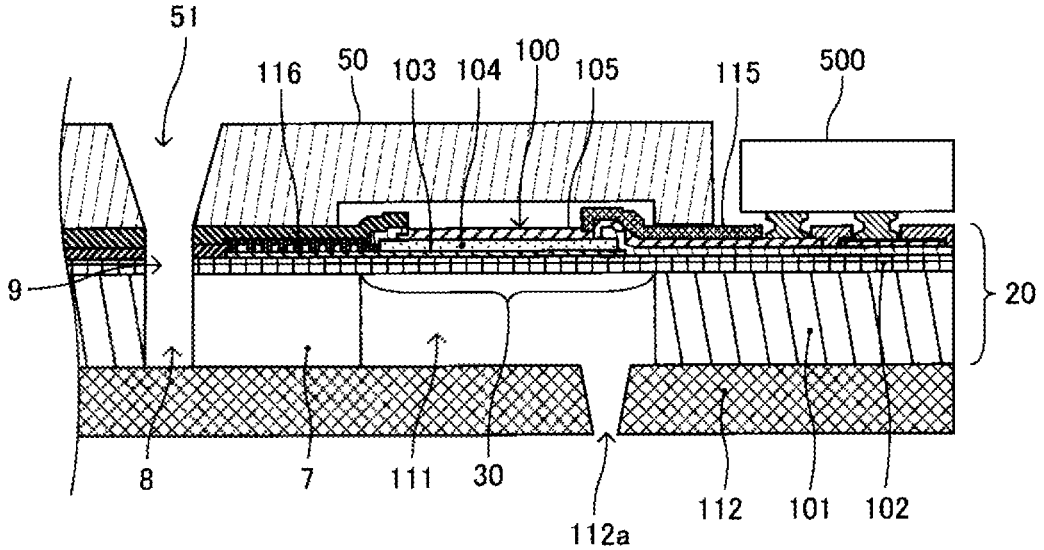
FIG. 11 is an enlarged cross-sectional explanatory view of a main portion of FIG. 10 according to exemplary aspects of the present disclosure.
Figure 12:
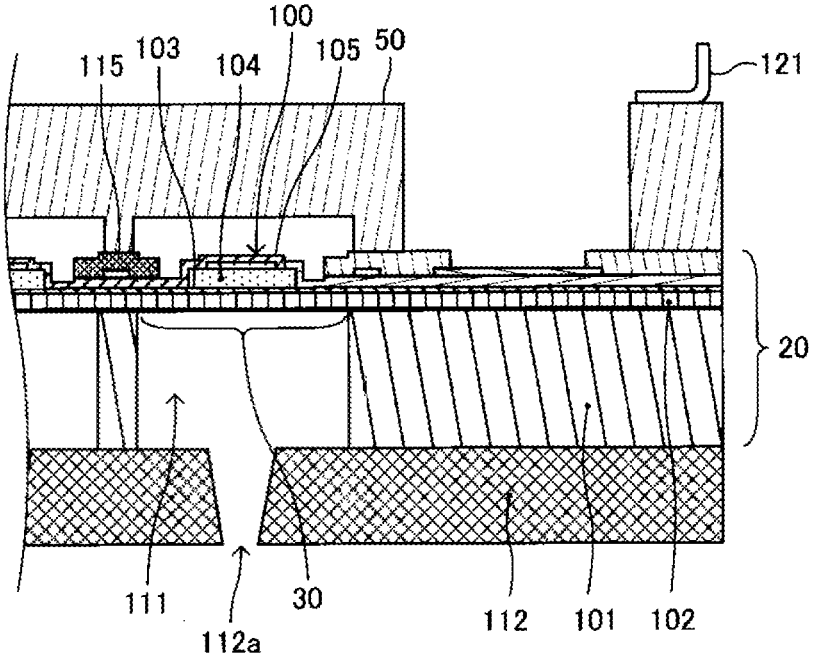
FIG. 12 is a cross-sectional explanatory view of a main portion along the head nozzle array direction according to exemplary aspects of the present disclosure.

FIG. 10 is a cross-sectional explanatory view along a direction orthogonal to a nozzle array direction of the head, FIG. 11 is an enlarged cross-sectional explanatory view of a main portion of FIG. 10, and FIG. 12 is a cross-sectional explanatory view of a main portion along the head nozzle array direction.

A liquid discharge head 110 includes a nozzle plate 112, a channel plate 101, a diaphragm member 102, a piezoelectric element 100 as a pressure generating element, a holding substrate 50, a wiring member 121 such as a flexible printed circuit (FPC), a common chamber member 70, and a cover member 45.

Here, a portion including the channel plate 101, the diaphragm member 102 and the piezoelectric element 100 is an actuator substrate 20.

The nozzle plate 112 has a plurality of nozzles 112*a* that discharges liquid. Here, four nozzle rows in which the nozzles 112*a* are arrayed are arranged.

The channel plate 101 forms together with the nozzle plate 112 and the diaphragm member 102: an individual liquid chamber 111 with which the nozzle 112*a* communicates; a fluid resistance 7 that communicates with the individual liquid chamber 111; and a liquid introduction 8 with which the fluid resistance 7 communicates.

The liquid introduction 8 communicates with a common chamber 10 formed by the common chamber member 70 via an opening 9 of the diaphragm member 102 and an opening 51 as a channel of the holding substrate 50.

The diaphragm member 102 forms a deformable vibration region 30 that forms a part of a wall surface of the individual liquid chamber 111. The diaphragm member 102 has a piezoelectric element 100 provided integrally with the vibration region 30, on a surface of the vibration region 30 opposite to the individual liquid chamber 111, and the vibration region 30 and the piezoelectric element 100 forms a piezoelectric actuator.

The lower electrode 103 as a common electrode of a plurality of the piezoelectric element 100 is coupled to a common electrode power supply wiring pattern 116. The lower electrode 103 is one electrode layer formed across all the piezoelectric elements 100 in a nozzle array direction. The upper electrode 105 as an individual electrode of the piezoelectric elements 100 is coupled to a driving IC (hereinafter referred to as a "driver IC") 500 as a driving circuit, via an individual wiring 114. The individual wiring 114 and the like are covered with a film. The actuator substrate 20 has the driver IC 500 mounted thereon by a method such as flip chip bonding so that the driver IC 500 covers a region between the rows of the piezoelectric element rows. The driver IC 500 mounted on the actuator substrate 20 is coupled to an individual electrode power supply wiring pattern to which a driving waveform (driving signal) is supplied. The actuator substrate 20 has the holding substrate 50 bonded to the diaphragm member 102 side of the actuator substrate 20 with an adhesive, and covering the piezoelectric element 100 on the actuator substrate 20.

The holding substrate 50 has an opening 51 that is a part of a channel with which the common chamber 10 and the individual liquid chamber 111 side communicate with each other; a recess 52 that accommodates the piezoelectric element 100; and an opening 53 that accommodates the driver IC 500. The opening 51 is a slit-like through-hole extending in the nozzle array direction, and is a part of the common chamber 10.

The holding substrate 50 is interposed between the actuator substrate 20 and the common chamber member 70 and is a part of the wall surface of the common chamber 10. The common chamber member 70 forms the common chamber 10 that supplies liquid to each individual liquid chamber 6. The common chamber 10 is provided corresponding to each of the four nozzle rows, and liquid of a required color is supplied to the common chamber 10 from outside. A damper member 150 is bonded to the common chamber member 70. The damper member 150 has a deformable damper 151 forming a wall surface of a part of the common chamber 10 and a damper plate 152 reinforcing the damper 151. The common chamber member 70 is bonded to the outer peripheral portion of the nozzle plate 1 and the holding substrate 50 with an adhesive, and accommodates the actuator substrate 20 and the holding substrate 50 to form a frame of the liquid discharge head 110. A cover member 45 is provided to cover the peripheral portion of the nozzle plate 112 and a part of the outer peripheral surface of the common chamber member 70.

In the liquid discharge head 110, a voltage is applied from the driver IC 500 to between the upper electrode 105 and the lower electrode 103 of the piezoelectric element 100, so that a piezoelectric layer expands in an electrode stacking direction, that is, an electric field direction, and contracts in a direction parallel with the vibration region 30. As a result, a tensile stress is generated on the side of the lower electrode 103 of the vibration region 30, and the vibration region 30 bends toward the individual liquid chamber 111, and pressurizes the liquid inside, so that the liquid is discharged from the nozzle 112*a*.

Next, examples of the piezoelectric element 100 according to the exemplary embodiment will be described.

First, a SiO2 film (film thickness: about 1.0 μm) was formed as the diaphragm layer 102 on a 6-inch silicon wafer as the substrate 101. Then, a Ti film (film thickness: about 20 [nm]) was formed on this SiO2 film by a sputtering method at 350° C., and was thermally oxidized at 750° C. by RTA (rapid thermal processing). Next, as the lower electrode layer 103, a Pt film (film thickness: about 160 nm) was formed by a sputtering method at about 300° C. The TiO 2 film obtained by thermally oxidizing the Ti film becomes an adhesion layer between the diaphragm layer 102 made of the SiO2 film and the lower electrode layer 103 made of the Pt film. A seed layer 106 was formed on the lower electrode layer 103 under the conditions (Examples 1 to 10 and Comparative Examples 1 and 2) shown in Table 1 below. The thickness of the seed layer 106 was 6 nm. Here, the composition liquids of the seed layers of Examples 1, 2, 3, 4, 5, 9, 10 and comparative examples 1 and 2 are PbxTiyO3 (x and y are composition ratios of Pb and Ti) liquids. The composition liquid of the seed layer of Examples 6, 7, and 8 is a PbxZryTizO3 (x, y, z is a composition ratio of Pb, Zr, and Ti) liquid.

TABLE 1

| | SEED LAYER COMPOSITION Pb/(Ti + Zr) | SEED LAYER COMPOSITION Ti/(Ti + Zr) | TEMPORARY SINTERING TEMPERATURE OF Pb [CELSIUS TEMPERATURE] | SEED LAYER TEM ANALYSIS RESULTS | PZT (100) ORIENTATION RATE[%] | PIEZOELECTRIC CONSTANT | VARIATION WITHIN THE CHIP [%] |
|---|---|---|---|---|---|---|---|
| EX1 | 1.1 | 1 | 360 | AMORPHOUS | 99.80 | −168 | 2.0 |
| EX2 | 1.1 | 1 | 300 | AMORPHOUS | 99.60 | −162 | 2.3 |
| EX3 | 1.1 | 1 | 420 | AMORPHOUS | 99.50 | −160 | 1.9 |
| EX4 | 0.7 | 1 | 370 | AMORPHOUS | 99.40 | −156 | 2.0 |
| EX5 | 1.5 | 1 | 350 | AMORPHOUS | 99.70 | −159 | 2.1 |
| EX6 | 1.1 | 0.7 | 360 | AMORPHOUS | 99.60 | −159 | 2.3 |
| EX7 | 1.1 | 0.3 | 380 | AMORPHOUS | 99.30 | −157 | 2.1 |
| EX8 | 1.2 | 0.5 | 370 | AMORPHOUS | 99.40 | −159 | 1.9 |
| EX9 | 1.7 | 1 | 380 | AMORPHOUS | 95.00 | −150 | 3.2 |
| EX10 | 0.6 | 1 | 380 | AMORPHOUS | 97.00 | −151 | 2.6 |
| CE1 | 1.1 | 1 | 450 | CRYSTAL (111) | 12.00 | −112 | 11.2 |
| CE2 | 1.1 | 1 | 200 | MIXED AMORPHOUS AND CRYSTALLINE (111) | 54.00 | −129 | 15.4 |

Further, as a material of the PZT film (piezoelectric film 104) formed on the seed layer 106, three kinds of PZT precursor coating solutions prepared with a composition ratio of Pb:Zr:Ti=115:49:51 were prepared. A specific PZT precursor coating solution was synthesized as follows.

First, lead acetate trihydrate, titanium isopropoxide, and zirconium isopropoxide were used as starting materials, and crystallization water of lead acetate was dissolved in methoxyethanol, followed by dehydration. The amount of lead is excessive with respect to the stoichiometric composition. This is to prevent deterioration of crystallinity due to so-called lead loss during heat treatment. Further, titanium isopropoxide and zirconium isopropoxide were dissolved in methoxyethanol to promote alcohol exchange reaction and esterification reaction. Then, the PZT precursor coating solution was synthesized by mixing with the methoxyethanol solution in which the lead acetate was dissolved. The PZT concentration in the PZT precursor coating solution was 0.5 mol/l. The PT coating liquid was also synthesized in the same manner as the PZT precursor coating liquid. Using these coating liquids, a PT layer was first formed by spin coating, and then dried at 120° C. with a hot plate. After that, as a calcination condition, a treatment was carried out at the calcination temperature shown in Table 1 (the same as the degreasing heat treatment temperature of the first layer of PZT in FIG. 5).

Next that, coating, drying, and calcination were repeated to form three layers, and after the thermal decomposition treatment of the third layer, heat treatment for crystallization (temperature 730° C.) was performed by RTA (rapid heat treatment). The film thickness of the PZT film after the heat treatment for crystallization was 240 nm. A PZT film (piezoelectric film 104) having a film thickness of about 2.0 μm is obtained by performing the steps of coating, drying, thermal decomposition and crystallization heat treatment of this PZT precursor solution a total of 8 times (24 layers).

Next, as the upper electrode layer 105, a SrRuO film (film thickness: 40 nm) which is an oxide film and a Pt film (film thickness: 125 nm) which is a metal film were formed by sputtering. Then, a photoresist (TSMR8800) manufactured by Tokyo Ohka Co., Ltd. was formed by a spin coating method, and a resist pattern was formed by ordinary photolithography. After that, an ICP etching device (manufactured by Samco) was used to form a pattern as illustrated in FIG. 9.

Next, as the first insulating protective film 113, an Al2O3 film of 50 [nm] was formed by using the ALD method. At this time, as for Al, TMA (Sigma Aldrich) was used. Regarding O, O3 generated by an ozone generator was used. Then, the films were formed by alternately stacking these. Then, as shown in FIG. 9, contact holes 113*a* and 113*b* were formed by etching. Then, Al was sputtered to form the lead wires 114 and 116, and patterned by etching. After that, as the second insulating protective film 115, Si3N4 of 500 nm was formed by plasma CVD to manufacture the piezoelectric element 100. After the production of the piezoelectric element 100, the crystallinity ((100) orientation ratio) of the PZT film (piezoelectric film 104) was evaluated by XRD measurement. The state of the seed layer 106 was evaluated by TEM observation of the cross section. The difference in conditions between Examples 1 to 10 and Comparative Examples 1 and 2 is as shown in Table 1 above. The evaluation results of the crystallinity of each PZT film (piezoelectric film 104) and the TEM observation results are also shown in Table 1 above.

Under all the conditions of Examples 1 to 10, it was confirmed from the TEM observation result that the seed layer 106 had an amorphous structure over the entire region. Moreover, it was confirmed by XRD measurement that the PZT film (piezoelectric film 104) exhibited a good (100) orientation ratio (95% or more). Particularly, in examples 1 to 8, the (100) orientation ratio of the PZT film (piezoelectric film 104) was 99% or more, which was even better.

On the other hand, in comparative examples 1 and 2, the seed layer 106 was present as a (111)-oriented crystallized film, or an amorphous region and a crystallized region were mixed. Further, the (100) orientation ratio of the PZT film (piezoelectric film 104) was not good.

Further, the piezoelectric constants of the produced piezoelectric elements 100 of examples 1 to 10 and comparative examples 1 and 2 were evaluated.

The displacement evaluation for obtaining the piezoelectric constant was performed by excavating the substrate 101 from the back surface side. The amount of deformation when an electric field of 150 [kV/cm] was applied was measured with a laser Doppler vibrometer. Then, the piezoelectric constant was calculated from the fitting by simulation. Under the conditions of examples 1 to 10, good results were also obtained regarding the piezoelectric constant. On the other hand, in comparative examples 1 and 2, good piezoelectric constants were not obtained.

Further, the variation in displacement within the piezoelectric element 100 was also evaluated. Under the conditions of examples 1 to 10, good results were obtained regarding this variation in displacement. On the other hand, in comparative examples 1 and 2, the displacement variation was large, and good results were not obtained.

Figure 13:
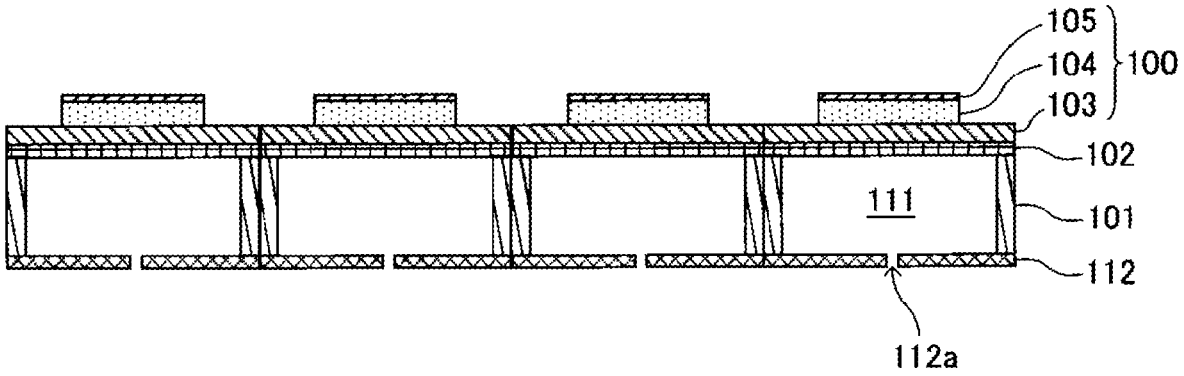
FIG. 13 is a cross-sectional explanatory view showing a liquid ejection head having a nozzle row in which a plurality of nozzles are arranged according to exemplary aspects of the present disclosure.

As shown in FIG. 13, a liquid ejection head 110 having a nozzle row in which a plurality of nozzles 112*a* are arranged was manufactured. Here, the ejection evaluation of the liquid was performed using the piezoelectric element 100 manufactured in the above-described examples 1 to 10 as the pressure applying unit that applies the pressure to the liquid in the pressure chamber 111 corresponding to each nozzle 112*a*. In this evaluation, an ink whose viscosity was adjusted to 5 cp was used as the liquid. In this evaluation, the ejection state when a driving voltage of −10 V to −30 V was applied was confirmed by a simple Push waveform. As a result, it was confirmed that the liquid was appropriately ejected from all the nozzles 112*a*.

Figure 14:
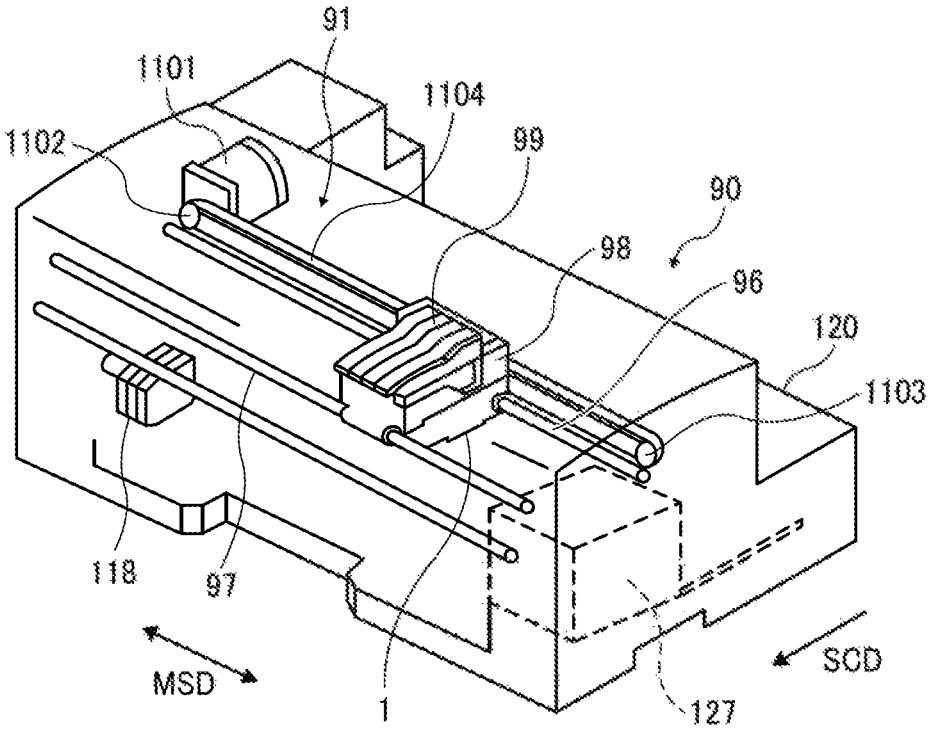
FIG. 14 is a perspective view of the inkjet recording apparatus according to exemplary aspects of the present disclosure.
Figure 15:
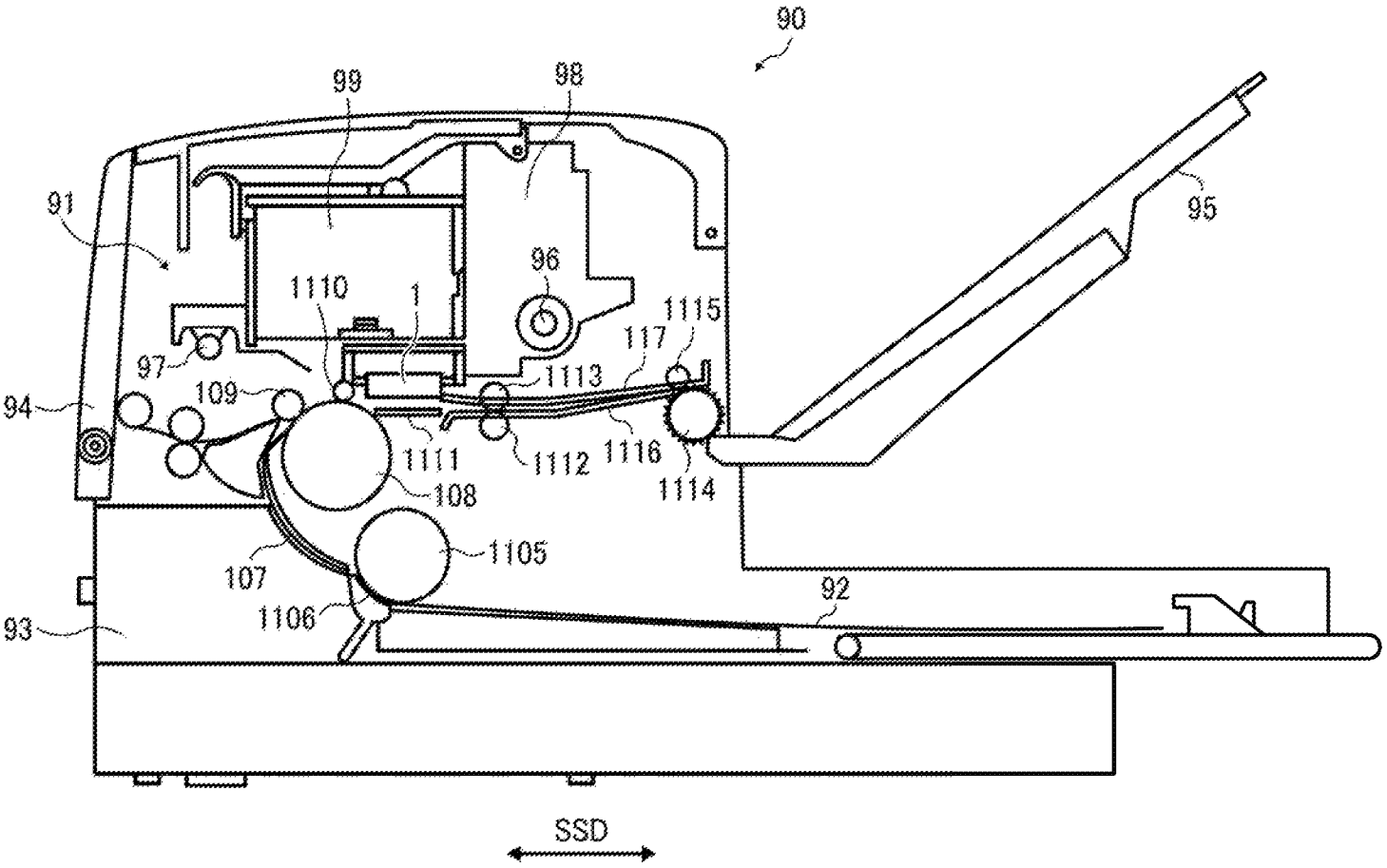
FIG. 15 is a side view of a mechanical section of the inkjet recording apparatus according to exemplary aspects of the present disclosure.

FIGS. 14 and 15 illustrate an inkjet recording apparatus 90 that is an example of a liquid discharge apparatus including the head 1 or liquid discharge device 440. FIG. 14 is a perspective view of the inkjet recording apparatus 90. FIG. 15 is a side view of a mechanical section of the inkjet recording apparatus 90 of FIG. 14. The head 1 is identical to the head 110 illustrated in FIGS. 1 to 13.

The inkjet recording apparatus 90 includes a printing assembly 91 inside an apparatus body 120. The printing assembly 91 includes a carriage 98, the head 1 mounted on the carriage 98, an ink cartridge 99 to supply ink to the head 1. The carriage 98 is movable in a main scanning direction as indicated by arrow "MSD" in FIG. 14.

A sheet feeding cassette 93 (or a sheet feeding tray) capable of loading a large number of sheets 92 from a front side of the apparatus body 120 is detachably attached to the lower part of the apparatus body 120. In addition, the inkjet recording apparatus 90 includes a bypass tray 94 openable to manually feed the sheets 92. Further, the sheets 92 fed from the sheet feeding cassette 93 or the bypass tray 94 is taken in, the required image is recorded by the printing assembly 91, and then ejected to the sheet ejection tray 95 mounted on a rear side of the apparatus body 120.

The printing assembly 91 holds the carriage 98 with a main guide rod 96 and a sub-guide rod 97 so that the carriage 98 is slidable in the main scanning direction MSD. The main guide rod 96 and the sub-guide rod 97 are guides laterally bridged between left and right-side plates.

The heads 1 discharge ink droplets of respective colors of yellow (Y), cyan (C), magenta (M), and black (Bk) and are mounted on the carriage 98 so that a plurality of ink discharge ports (nozzles 6) is arrayed in a direction intersecting the main scanning direction MSD. The heads 1 are mounted on the carriage 98 such that the head 1 discharges ink droplets downward. Further, the ink cartridges 99 to supply ink of each color to the head 1 are exchangeably mounted on the carriage 98.

Each of the ink cartridges 99 includes an air communication port communicated with the atmosphere in an upper portion of each ink cartridges 99, an ink supply port in a lower portion of each ink cartridges 99 to supply ink to the head 1, and a porous body to be filled with ink inside each ink cartridge 99. The ink supplied to the head 1 is maintained at a slight negative pressure by the capillary force of the porous body in the ink cartridges 99. Although four heads 1 of respective colors are used as the head 1, the head 1 may be a single head having nozzles 6 discharging ink droplets of each colors.

The carriage 98 is slidably fitted on the main guide rod 96 on the rear side (downstream side in a sheet conveyance direction) and slidably mounted on the sub-guide rod 97 on the front side (upstream side in the sheet conveyance direction). To scan the carriage 98 in the main scanning direction MSD, a timing belt 1104 is stretched between a driving pulley 111102 driven and rotated by a main scanning motor 1101 and a driven pulley 1103. The timing belt 1104 is secured to the carriage 98. The carriage 98 is reciprocally moved by forward and reverse rotations of the main scanning motor 1101.

The inkjet recording apparatus 90 further includes a sheet feed roller 11105, a friction pad 1106, a sheet guide 107, a conveyance rollers 108 and 109, and a leading end roller 1110 to convey the sheet 92, which is set in the sheet feeding cassette 93, to a portion below the heads 1. The sheet feed roller 11105 and the friction pad 1106 separates and feeds the sheets 92 sheet by sheet from the sheet feeding cassette 93.

The sheet guide 107 guides the sheets 92. The conveyance roller 108 reverses and conveys the sheet 92 fed from the sheet feed roller 11105. The conveyance roller 109 is pressed against a circumferential surface of the conveyance roller 108. The leading end roller 1110 defines an angle at which the sheet 92 is fed from the conveyance rollers 108 and 109. The conveyance roller 108 is driven to rotate via a gear train by a sub-scanning motor 118.

A print receiver 1111 as a sheet guide is provided to guide the sheet 92 fed from the conveyance roller 108 below the heads 1 in accordance with the movement range of the carriage 98 in the main scanning direction MSD. On a downstream side of the print receiver 1111 in the sheet conveyance direction (sub-scanning direction indicated by arrow SSD in FIG. 14), the inkjet recording apparatus 90 includes a conveyance roller 1112, a spur roller 1113, a sheet ejection roller 1114, a spur roller 1115, and guides 1116 and 117. The conveyance roller 1112 is driven to rotate with the spur roller 1113 to feed the sheet 92 in a sheet ejection direction. The sheet ejection roller 1114 and the spur roller 1115 further feed the sheet 92 to the sheet ejection tray 95. The guides 1116 and 117 form a sheet ejection path.

In recording, the inkjet recording apparatus 90 drives the head 1 in response to image signals while moving (scanning) the carriage 98, discharges ink to the stopped sheet 92 to record one line of a desired image onto the sheet 92, and feeds the sheet 92 in a predetermined amount, and then records a next line on the sheet 92. When the inkjet recording apparatus 90 receives a signal indicating that a rear end of the sheet 92 has reached a recording area or an end of recording operation, the inkjet recording apparatus 90 terminates a recording operation and ejects the sheet 92.

Further, the recovery device 127 to recover a discharge failure of the head 1 is disposed at a position out of the recording area on a right side in the moving direction (main scanning direction MSD) of the carriage 98. The recovery device 127 includes a cap, a suction unit, and a cleaning unit. In printing standby state, the carriage 98 is moved and placed at the side in which the recovery device 127 is disposed, and the heads 1 are capped with the capping unit.

Accordingly, the nozzles 6 are maintained in a wet state, thus preventing occurrence of a discharge failure due to ink dry. The inkjet recording apparatus 90 discharges ink not relating to the recording in the middle of the recording, for example, to maintain the viscosity of ink in all of the nozzles 6 constant, thus maintaining the head 1 to stably discharge the liquid (ink).

When a discharge failure has occurred, the nozzles 6 of the heads 1 are tightly sealed with the cap, the suction unit sucks ink and bubbles, for example, from the nozzles 6 via tubes, and the cleaning unit removes ink and dust adhered to the nozzle surface 310 of the nozzles 6, thus recovering the discharge failure. The sucked ink is discharged to a waste ink container disposed on a lower portion of an apparatus body 120, and is absorbed into and retained in an ink absorber in the waste ink container.

The inkjet recording apparatus 90 mounts the heads 1 manufactured by the method according to the present disclosure. Thus, the heads 1 can stably discharge the ink droplets and thus increase the image quality.

Although the above-described embodiments describes the head 1 used to the inkjet recording apparatus 90, the head 1 may be used to a device that discharges liquid other than ink, for example, a liquid resist for patterning.

Figure 16:
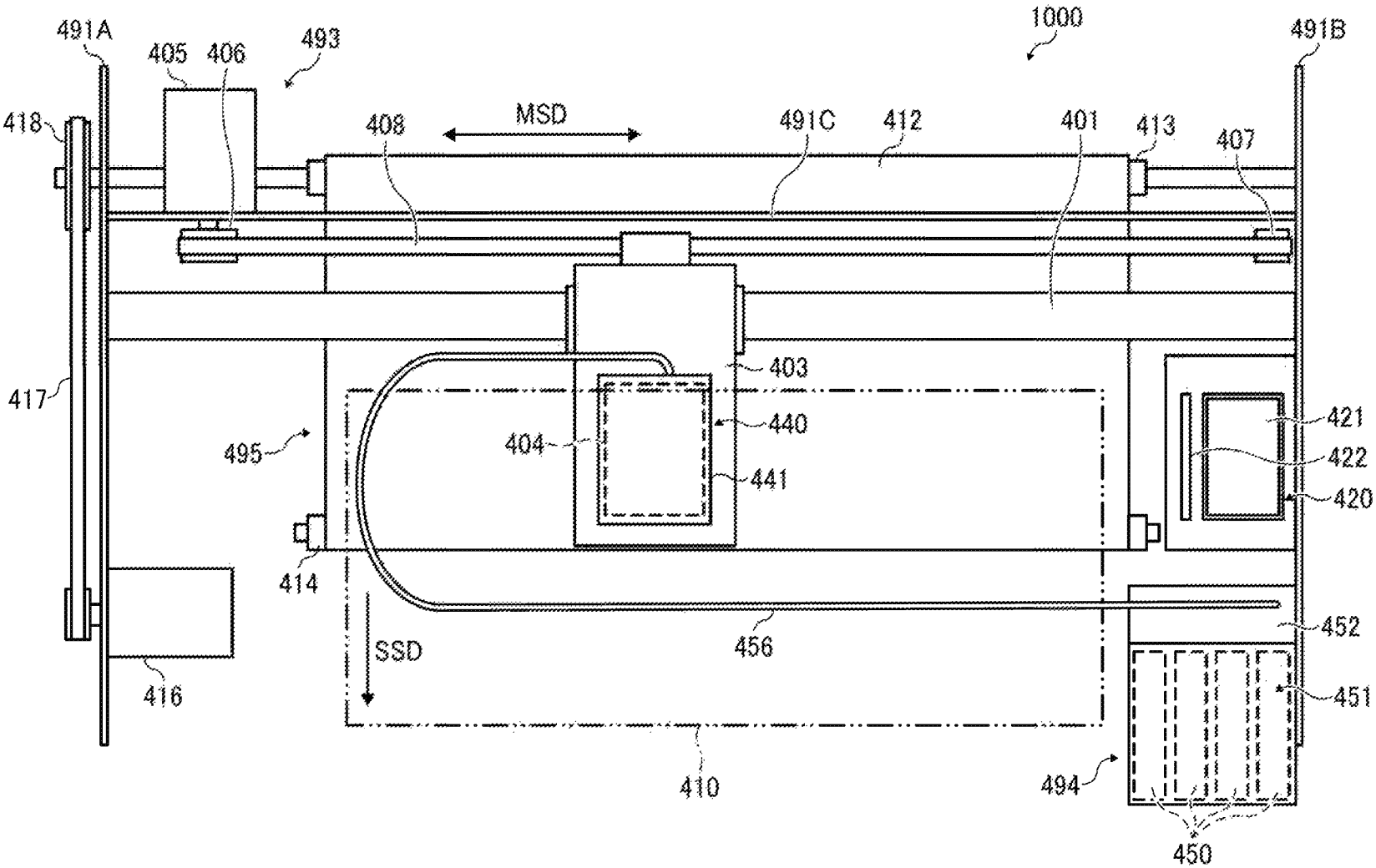
FIG. 16 is an explanatory plan view of a main portion of the liquid discharge apparatus according to exemplary aspects of the present disclosure.
Figure 17:
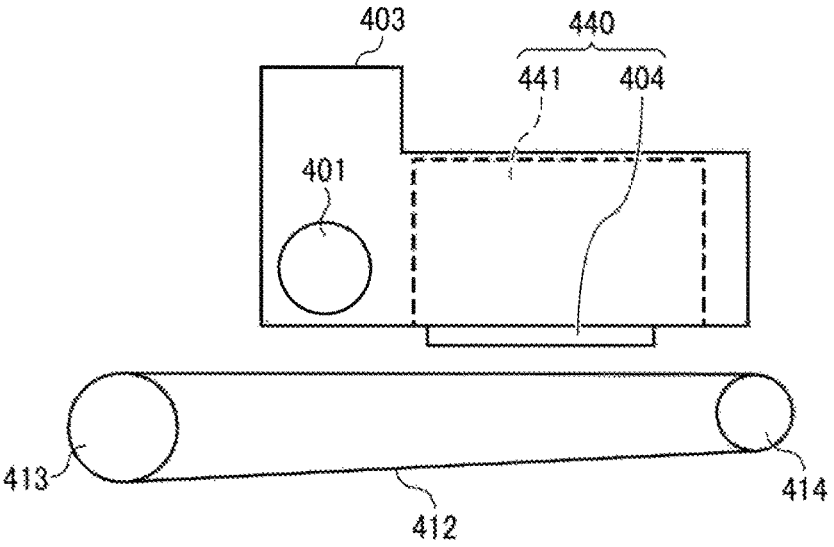
FIG. 17 is an explanatory side view of a main portion of the liquid discharge apparatus according to exemplary aspects of the present disclosure.
Figure 18:
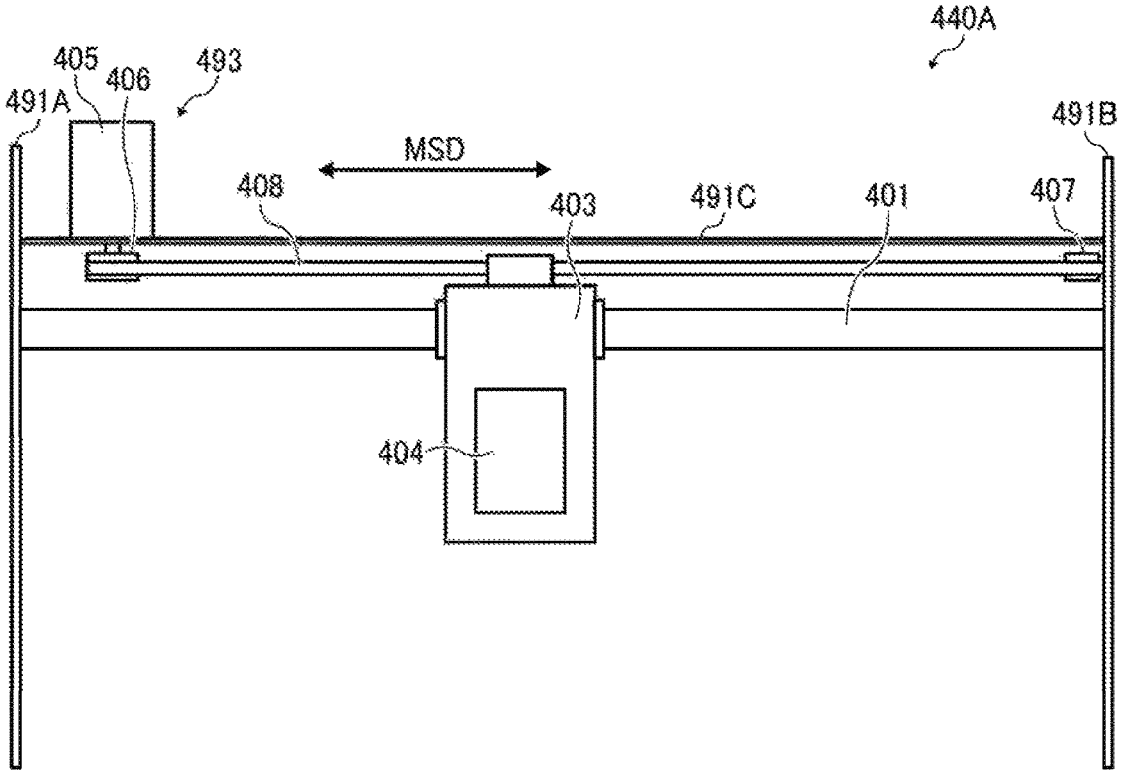
FIG. 18 is a plan view of a main part of the liquid ejection device according to exemplary aspects of the present disclosure.

Next, a liquid discharge apparatus according to an embodiment of the present disclosure will be described with reference to FIGS. 16 and 17. FIG. 16 is an explanatory plan view of a main portion of the liquid discharge apparatus. FIG. 17 is an explanatory side view of a main portion of the liquid discharge apparatus.

The liquid discharge apparatus according to the present embodiment is a serial type apparatus, and a carriage 403 reciprocates in a main-scanning direction indicated by arrow MSD in FIG. 16 with a main scanning movement mechanism 493. The main scanning movement mechanism 493 includes a guide member 401, a main scanning motor 405, a timing belt 408, and the like. The guide member 401 is bridged between left and right side plates 491A and 491B so as to movably hold the carriage 403. The carriage 403 reciprocates in the main-scanning direction by the main scanning motor 405 via the timing belt 408 bridged between a driving pulley 406 and a driven pulley 407.

The carriage 403 is mounted with a liquid discharge device 440 in which a liquid discharge head 404 and a head tank 441 are integrated according to the present disclosure. The liquid discharge head 404 of the liquid discharge device 440 discharges liquid of each color, for example, yellow (Y), cyan (C), magenta (M), and black (K). The liquid discharge head 404 has a nozzle row including a plurality of nozzles and arranged in a sub-scanning direction indicated by arrow SSD in FIG. 15 orthogonal to the main-scanning direction, and is mounted so that the discharge direction faces downward.

A supply mechanism 494 is for supplying liquid stored in the outside of the liquid discharge head 404 to the liquid discharge head 404. The supply mechanism 494 supplies liquid stored in a liquid cartridge 450 to the head tank 441.

The supply mechanism 494 includes: a cartridge holder 451 that is a filling unit mounted with the liquid cartridge 450; a tube 456; a liquid transfer unit 452 including a liquid transfer pump; and the like. The liquid cartridge 450 is detachably mounted to the cartridge holder 451. The liquid transfer unit 452 sends liquid from the liquid cartridge 450 to the head tank 441 via the tube 456.

This apparatus includes a conveying mechanism 495 that conveys paper 410. The conveying mechanism 495 includes a conveying belt 412 as a conveying means and a sub-scanning motor 416 for driving the conveying belt 412.

The conveying belt 412 attracts the paper 410 and conveys the paper 410 at a position facing the liquid discharge head 404. The conveying belt 412 is an endless belt, and is bridged between a conveying roller 413 and a tension roller 414. The attraction can be performed by electrostatic attraction, air attraction, or the like.

The conveying belt 412 circulates in the sub-scanning direction by rotation of the conveying roller 413 via a timing belt 417 and a timing pulley 418 by the sub-scanning motor 416.

On one side of the carriage 403 in the main-scanning direction, a maintenance and recovery mechanism 420 for maintaining and recovering the liquid discharge head 404 is arranged on the side of the conveying belt 412.

The maintenance and recovery mechanism 420 includes, for example, a cap member 421 that caps the nozzle surface (surface on which a nozzle is formed) of the liquid discharge head 404, a wiper member 422 that wipes the nozzle surface, and the like.

The main scanning movement mechanism 493, the supply mechanism 494, the maintenance and recovery mechanism 420, and the conveying mechanism 495 are attached to a housing including the side plates 491A and 491B and a back plate 491C.

In this apparatus configured as described above, the paper 410 is fed and attracted onto the conveying belt 412, and the paper 410 is conveyed in the sub-scanning direction by circulation of the conveying belt 412.

Therefore, the liquid discharge head 404 is driven according to an image signal while the carriage 403 is moved in the main-scanning direction, so that the liquid is discharged onto the paper 410 that is stopping to form an image.

In this way, since this apparatus includes the liquid discharge head according to the present embodiment, high-quality images can be stably formed.

Next, the liquid discharge device according to another embodiment of the present disclosure will be described with reference to FIG. 17. FIG. 17 is an explanatory plan view of a main portion of the liquid discharge device.

The liquid discharge device 440A according to the present embodiment includes: among members included in the liquid discharge apparatus 1000, a casing including the side plates 491A and 491B, and the back plate 491C; the main scanning movement mechanism 493; the carriage 403; and the liquid discharge head 404.

Note that the liquid discharge device 440A may further include at least one of the maintenance and recovery mechanism 420 and the supply mechanism 494 in, for example, the side plate 491B of the liquid discharge device 440A.

Figure 19:
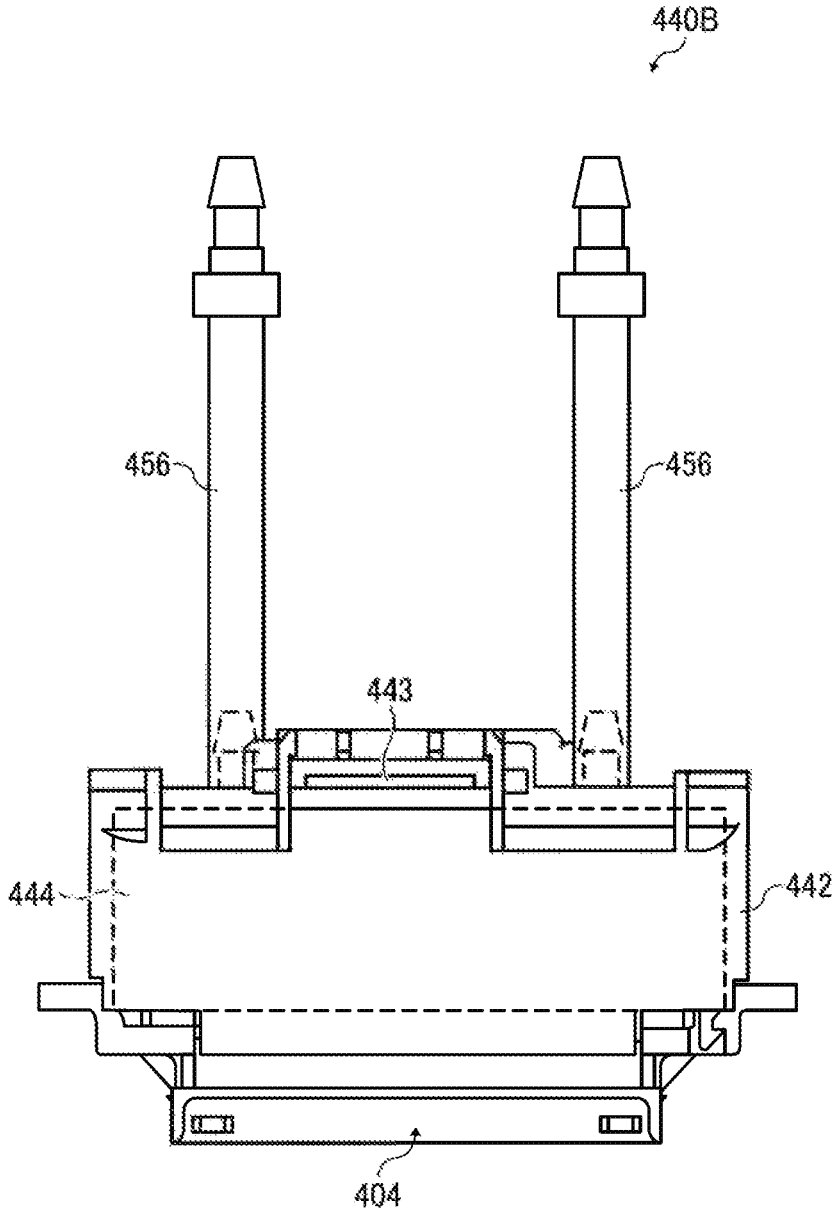
FIG. 19 is an explanatory front view of the liquid discharge device according to exemplary aspects of the present disclosure.

Next, the liquid discharge device according to still another embodiment of the present disclosure will be described with reference to FIG. 19. FIG. 19 is an explanatory front view of the liquid discharge device.

The liquid discharge device 440B according to the present embodiment includes the liquid discharge head 404 to which a channel component 444 that is a liquid supply member is attached, and a tube 456 coupled to the channel component 444.

Note that the channel component 414 is arranged inside a cover 442. Instead of the channel component 444, a head tank 441 can be included. The channel component 444 has a connector 443 that electrically couples with the liquid discharge head 404 on the upper part of the channel component 444.

In the present application, the discharged liquid may be any liquid having viscosity and surface tension with which discharge can be performed from the head, and is not particularly limited. However, it is preferable that the liquid has viscosity of 30 mPa·s or less at ordinary temperature and ordinary pressure or by heating and cooling. More specifically, the liquid is solution, suspension, emulsion, or the like including a solvent such as water or an organic solvent, a colorant such as a dye or a pigment, a functionalizing material such as a polymerizable compound, a resin or a surfactant, a biocompatible material such as DNA, amino acid, protein, or calcium, an edible material such as a natural pigment, and the like, which can be used, for example, as formation liquid of an inkjet ink, a surface treatment liquid, constituent elements of an electronic element or a light-emitting element, and an electronic circuit resist pattern, three-dimensional modeling material solution, or the like.

Examples of an energy generation source that discharges liquid include one that uses a thermal actuator using an electrothermal transducer such as a piezoelectric actuator (laminated type piezoelectric element and thin film type piezoelectric element), or a heating resistor, an electrostatic actuator including a diaphragm and a counter electrode, and the like.

The "liquid discharge device" is a liquid discharge head integrated with functional parts and mechanisms, and includes a group of components related to discharge of liquid. Examples of the "liquid discharge device" include a liquid discharge head combined with at least one of a head tank, a carriage, a supply mechanism, a maintenance and recovery mechanism, and a main scanning movement mechanism.

Here, integration means, for example, one in which the liquid discharge head, the functional parts, and the mechanism are secured to each other by fastening, adhesion, engagement, or the like, and one in which one is held movably with respect to the other. The liquid discharge head, the functional parts, and the mechanism may be configured to be detachable from each other.

For example, there is a liquid discharge device in which a liquid discharge head and a head tank are integrated. In addition, there is liquid discharge device in which a liquid discharge head and a head tank are coupled to each other by a tube or the like so as to be integrated with each other. Here, a unit including a filter may be added between the head tank of these liquid discharge device and liquid discharge head.

There is a liquid discharge device in which a liquid discharge head and a carriage are integrated. There is a liquid discharge device in which a liquid discharge head is movably held on a guide member forming a part of the scanning movement mechanism, and the liquid discharge head and the scanning movement mechanism are integrated. There is a liquid discharge device in which a liquid discharge head, a carriage, and a main scanning movement mechanism are integrated.

There is a liquid discharge device in which a cap member, which is a part of a maintenance and recovery mechanism, is secured to a carriage to which a liquid discharge head is attached, so that the liquid discharge head, the carriage, and the maintenance and recovery mechanism are integrated.

There is a liquid discharge device in which a tube is coupled to a liquid discharge head to which a head tank or a channel component is attached, and the liquid discharge head and the supply mechanism are integrated. Through this tube, the liquid of the liquid storage source is supplied to the liquid discharge head. The main scanning movement mechanism also includes a single guide member. The supply mechanism also includes a single tube and a single filling unit.

Examples of the "liquid discharge apparatus" include an apparatus that includes a liquid discharge head or a liquid discharge device, and drives the liquid discharge head to discharge liquid. Examples of the liquid discharge apparatus include not only an apparatus that can discharge liquid to a liquid adherable material but also an apparatus that discharges liquid towards air or liquid.

This "liquid discharge apparatus" may include a means related to feeding of a liquid adherable material, conveying, and sheet ejection, a preprocessing device, a post-processing device, or the like. For example, as a "liquid discharge apparatus", there are an image forming apparatus that is an apparatus that discharges ink to form an image on paper, and a stereoscopic modeling apparatus (three-dimensional modeling apparatus) that discharges modeling liquid onto a powder layer in which powder materials are formed in a layered shape in order to mold a stereoscopic modeling apparatus (three-dimensional modeling apparatus).

The "liquid discharge apparatus" is not limited to one with which significant images such as letters, graphics, or the like is visualized by discharged liquid. For example, one that forms a pattern or the like that itself has no meaning, and one that molds a three-dimensional image are included.

The above-mentioned "liquid adherable material" means one to which liquid can be adhered at least temporarily, adhered and fastened, adhered and permeated, or the like. Specific examples include a recording medium such as paper, a recording sheet, recording paper, a film, or a cloth, an electronic component such as an electronic substrate or a piezoelectric element, and a medium such as a powder material layer (powder layer), organ model, or an inspection cell, and unless specifically limited, include everything to which liquid adheres.

The material of above-mentioned "liquid adherable material" may be any material such as paper, thread, fiber, cloth, leather, metal, plastic, glass, wood, ceramics or the like as long as liquid can adhere to the material even temporarily.

As the "liquid discharge apparatus", there is an apparatus in which a liquid discharge head and a liquid adherable material move relative to each other, but this is not a limitation. Specific examples include a serial type apparatus that moves the liquid discharge head, a line type apparatus that does not move the liquid discharge head, or the like.

As a "liquid discharge apparatus", there are also a treatment liquid application apparatus that discharges treatment liquid onto paper in order to apply the treatment liquid to the surface of the sheet for the purpose of modifying the surface of the paper or the like, an injection granulation apparatus that granulates fine particles of a raw material by injecting a composition liquid in which raw materials are dispersed in a solution, through a nozzle, and the like.

In the terms of the present application, image formation, recording, typing, imaging, printing, molding and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What has been described above is an example, and unique effects are obtained for each of the following aspects.

[First Mode]

In the first mode, a piezoelectric body (eg, piezoelectric film 104) containing lead zirconate titanate (PZT) is provided between a lower electrode (eg, lower electrode layer 103) and an upper electrode (eg, upper electrode layer 105). The piezoelectric element 100. A seed layer 106 containing a lead compound is provided between the lower electrode and the piezoelectric body. Further, the seed layer has an amorphous structure over at least the entire surface layer portion. For example, there is a case where it is desired to form a (100)-oriented PZT having good piezoelectric characteristics on a lower electrode made of a (111)-oriented platinum (Pt) layer via a seed layer. In this case, if a crystallized region exists in the seed layer, the crystal growth of PZT is affected by the crystal characteristics of the lower electrode when PZT crystal is grown on the seed layer. As a result, it is difficult to obtain PZT having a desired (100)-oriented crystal structure.

In this aspect, the seed layer has an amorphous structure over at least the entire surface layer portion. That is, the structure has substantially no crystallized region. By providing such a seed layer, even if the lower electrode can prevent crystal growth of PZT having a desired crystal structure, the seed layer having an amorphous structure blocks the influence of the lower electrode. Then, PZT can be grown into a desired crystal structure. Therefore, it is possible to provide the piezoelectric element including the PZT having the desired crystal structure on the lower electrode that can prevent the crystal growth of the PZT having the desired crystal structure.

[Second Mode]

The second mode is characterized in that, in the first aspect, the lead compound is lead titanate (PbTiO3). With this, the seed layer having an amorphous structure can block the influence of the lower electrode, and the PZT serving as a piezoelectric body can be crystal-grown into a desired crystal structure.

[Third Mode]

The third mode is characterized in that, in the second mode, the composition ratio Pb/Ti of the lead titanate is 0.7 or more and 1.5 or less. Due to this, it is possible to suppress a decrease in the orientation rate of PZT that constitutes the piezoelectric body.

[Fourth Mode]

A fourth mode is characterized in that, in the second or third mode, the film thickness of the seed layer is 3 nm or more and 15 nm or less. Due to this, it is possible to suppress a decrease in the orientation rate of PZT that constitutes the piezoelectric body.

[Fifth Mode]

A fifth mode is characterized in that, in the first mode, the lead compound is lead zirconate titanate (Pb(ZrTi) O3). With this, the seed layer having an amorphous structure can block the influence of the lower electrode, and the PZT serving as a piezoelectric body can be crystal-grown into a desired crystal structure.

[Sixth Mode]

The sixth mode is characterized in that, in the fifth mode, the composition ratio Ti/(Zr+Ti) of the lead zirconate titanate is 0.3 or more. Due to this, it is possible to suppress a decrease in the orientation rate of PZT that constitutes the piezoelectric body.

[Seventh Mode]

A seventh mode is characterized in that, in any one of the first to sixth modes, the lower electrode is composed of a platinum layer and an adhesion layer containing titanium oxide. Due to this, even if platinum (Pt) having high heat resistance and low reactivity is used as the lower electrode, the adhesion layer can ensure the adhesion to the underlying layer (diaphragm layer).

[Eighth Mode]

An eighth mode is characterized in that, in any one of the first to seventh modes, the composition ratio Ti/(Zr+Ti) of lead zirconate titanate constituting the piezoelectric body is 0.4 or more and 0.55 or less. Due to this, it is possible to suppress a decrease in the orientation rate of PZT that constitutes the piezoelectric body.

[Ninth Mode]

According to a ninth mode, in any one of the first to eighth modes, the piezoelectric body has an orientation degree (orientation rate) of (100) orientation of 99% or more by θ-2θ measurement by an X-ray diffraction method. With this, it is possible to obtain a piezoelectric element having good piezoelectric characteristics.

What is claimed is:

1. A piezoelectric element comprising:

an upper electrode;

a lower electrode;

a piezoelectric body containing lead zirconate titanate disposed between the lower electrode and the upper electrode, the piezoelectric body having a crystal structure; and a seed layer containing lead disposed between the lower electrode and the piezoelectric body, wherein the seed layer is entirely amorphous, and wherein the seed layer has a thickness of 3 nm or more and 15 nm or less.

2. The piezoelectric element according to claim 1, wherein the seed layer is lead titanate.

3. The piezoelectric element according to claim 2, wherein a composition ratio of Pb/Ti of lead titanate of the seed layer is between 0.7 and 1.5.

4. The piezoelectric element according to claim 1, wherein the seed layer is lead zirconate titanate.

5. The piezoelectric element according to claim 4, wherein the composition ratio of Ti/(Zr+Ti) of the lead zirconate titanate of the seed layer is 0.3 or more.

6. The piezoelectric element according to claim 1, wherein the lower electrode is composed of a platinum layer and an adhesion layer containing titanium oxide.

7. The piezoelectric element according to claim 1, wherein a composition ratio Ti/(Zr+Ti) of lead zirconate titanate forming the piezoelectric body is between 0.4 and 0.55.

8. The piezoelectric element according to claim 1, wherein the piezoelectric body has an orientation degree of (100) orientation of 99% or more measured by θ−2θ by an X-ray diffraction method.

9. A liquid discharge head comprising the piezoelectric element according to claim 1.

10. A liquid discharge device comprising the liquid discharge head according to claim 9.

11. The liquid discharge device according to claim 10, further comprising at least one of:

a head tank to store liquid to be supplied to the liquid discharge head;

a carriage to mount the liquid discharge head;

a supply device to supply the liquid to the liquid discharge head;

a maintenance device to maintain the liquid discharge head; and a drive device to move the carriage in a main scanning direction, together with the liquid discharge head to form a single unit.

12. A liquid discharge apparatus comprising the piezoelectric element according to claim 1.

13. A method of forming a piezoelectric element, comprising:

providing an upper electrode and a lower electrode;

providing a piezoelectric body containing lead zirconate titanate between the lower electrode and the upper electrode; and forming a seed layer containing lead, which has an amorphous structure over at least the entire surface layer portion on the piezoelectric body side, on the lower electrode directly or through another layer, wherein a crystal of lead zirconate titanate is grown on the seed layer to form the piezoelectric body, and wherein the seed layer has the amorphous structure at least over an entire surface layer portion on the piezoelectric body side at a time when the piezoelectric body has a crystal structure, and the seed layer is entirely amorphous at a time when the piezoelectric body has a crystal structure, and wherein the seed layer has a thickness of 3 nm or more and 15 nm or less.

14. The piezoelectric element of claim 1, further comprising:

an insulating protective film including any one of $Al_2O_3$, $ZrO_2$, $Y_2O_3$, $Ta_2O_3$, and $TiO_2$.

15. The piezoelectric element of claim 14, wherein the insulating protective film has a thickness ranging from 20 nm to 100 nm.

16. The piezoelectric element of claim 14, wherein the insulating protective film has a first layer and a second layer.

17. The piezoelectric element of claim 16, wherein:

the first layer is a protective film including any one of $Al_2O_3$, $ZrO_2$, $Y_2O_3$, $Ta_2O_3$, and $TiO_2$, and the second layer is a protective film including $SiO_2$.

18. The piezoelectric element of claim 1, further comprising:

an insulating protective film having a thickness of 200 nm or more.

* * * * *